US010426215B2

(12) United States Patent
Morin et al.

(10) Patent No.: US 10,426,215 B2
(45) Date of Patent: Oct. 1, 2019

(54) HELMET WITH FACEMASK ADJUSTMENT MECHANISM

(71) Applicant: SPORT MASKA INC., Montreal (CA)

(72) Inventors: Sebastien Morin, Brossard (CA); Pierre-Luc Beauchamp, Montreal (CA); Simon Langlois, Notre-Dame-de-I'Île-Perrot (CA); Brian William Steenbrink, Pointe-Claire (CA); Nicole Jacqueline Wiart, Montreal (CA); Simon-Pierre Germain, Granby (CA)

(73) Assignee: SPORT MASKA INC., Montreal, Quebec ( * ) Notice: Subject to any disclaimer, the term of this patent is extended or adjusted under 35 U.S.C. 154(b) by 150 days.

(21) Appl. No.: 15/381,180

(22) Filed: Dec. 16, 2016

(65) Prior Publication Data

US 2017/0311669 A1 Nov. 2, 2017

Related U.S. Application Data

(60) Provisional application No. 62/329,334, filed on Apr. 29, 2016.

(51) Int. Cl.

| | |
|---|---|
| ***A42B 3/20*** | (2006.01) |
| ***A42B 3/32*** | (2006.01) |
| *A42B 3/04* | (2006.01) |

(52) U.S. Cl.

CPC ..... *A42B 3/324* (2013.01); *A42B 3/20* (2013.01); *A42B 3/205* (2013.01); *A42B 3/326* (2013.01)

(58) Field of Classification Search

CPC .. A42B 3/20; A42B 3/08; A42B 3/326; A42B 3/205; A42B 3/127; A42B 3/18;

(Continued)

(56) References Cited

U.S. PATENT DOCUMENTS 4,587,677 A * 5/1986 Clement ..... A42B 3/20 2/424
5,412,814 A * 5/1995 Pernicka ..... A42B 3/20 2/424

(Continued)

FOREIGN PATENT DOCUMENTS

CA 1116801 1/1982
CA 1235852 5/1988

(Continued)

OTHER PUBLICATIONS

Canadian Patent Office Action dated Jan. 9, 2018.

*Primary Examiner* — Robert H Muromoto, Jr.
(74) *Attorney, Agent, or Firm* — Norton Rose Fulbright Canada

(57) ABSTRACT

A protective helmet including a helmet body, a facemask extending from the front portion to cover at least a portion of a face of a wearer, and one or more adjustment mechanisms securing the facemask to the helmet body. The adjustment mechanism(s) is/are connected to the helmet, include (s) an engagement member engaged with the facemask, is/are selectively engageable with the facemask in at least two vertically spaced apart positions of the facemask relative to the helmet body, and allow(s) toolless adjustment between the vertically spaced apart positions. Adjustment mechanisms and methods of positioning a facemask are also discussed.

16 Claims, 22 Drawing Sheets

(58) Field of Classification Search
CPC ..... A42B 3/221; A42B 3/185; A42B 3/225; A63B 71/10; A63B 2102/24
See application file for complete search history.

(56) References Cited

U.S. PATENT DOCUMENTS 5,502,843 A * 4/1996 Strickland ..... A42B 3/20 2/424
5,675,875 A * 10/1997 Servatius ..... A42B 3/20 2/424
6,079,053 A * 6/2000 Clover, Jr. ..... A42B 3/20 2/424
6,301,719 B1 * 10/2001 Goodhand ..... A42B 3/20 2/422
6,959,989 B2 * 11/2005 Holm ..... A42B 3/185 2/10
7,540,034 B2 * 6/2009 Bologna ..... A42B 3/20 2/424
8,695,122 B2 * 4/2014 DeBoer ..... A42B 3/20 2/424
8,719,968 B2 * 5/2014 DeBoer ..... A42B 3/20 2/424
8,997,266 B2 4/2015 DeBoer
2007/0016998 A1 * 1/2007 Reddington ..... A42B 3/225 2/5
2008/0109946 A1 * 5/2008 Jourde ..... A42B 3/08 2/410
2009/0113606 A1 * 5/2009 Jourde ..... A42B 3/08 2/421
2015/0033455 A1 * 2/2015 Beauchamp ..... A42B 3/08 2/414

FOREIGN PATENT DOCUMENTS

CA 2320634 9/2000
CA 2640596 3/2002
CA 2640628 3/2002

* cited by examiner

HELMET WITH FACEMASK ADJUSTMENT MECHANISM

CROSS-REFERENCE TO RELATED APPLICATIONS

This application claims priority from U.S. provisional application No. 62/329,334 filed Apr. 29, 2016, the entire contents of which are incorporated by reference herein.

TECHNICAL FIELD

The application relates generally to protective helmets and, more particularly, to helmets with adjustable facemasks.

BACKGROUND OF THE ART

Some protective helmets are used with a facemask for protecting the face of the wearer of the helmet. It is known to adjust the position of the facemask with respect to the helmet in order to position the facemask to the satisfaction of the wearer.

However, some conventional helmets require tools to remove the facemask from the helmet and/or adjust its position. In addition, some of these helmets require assistance to adjust the position of the facemask while the helmet is placed on the head of the wearer. These encumbrances limit the ability of the wearer to quickly and easily adjust the position of the facemask.

SUMMARY

In one aspect, there is provided a protective helmet comprising: a helmet body; a facemask extending from the front portion to cover at least a portion of a face of a wearer; at least one adjustment mechanism securing the facemask to the helmet body, the at least one adjustment mechanism connected to the helmet and including an engagement member engaged with the facemask, the at least one adjustment mechanism being selectively engageable with the facemask in at least two vertically spaced apart positions of the facemask relative to the helmet body, the at least one adjustment mechanism allowing toolless adjustment between the at least two vertically spaced apart positions.

In another aspect, there is provided an adjustment mechanism for connecting a facemask to a helmet, the adjustment mechanism comprising: a base configured to be connected to a helmet body of the helmet; and an engagement member connected to the base and defining at least two vertically spaced apart seat portions, each of the seat portions configured for engaging and disengaging a same portion of the facemask in a toolless manner to provide adjustment of a vertical position the facemask relative to the helmet body.

In another aspect, there is provided an adjustment mechanism for connecting a facemask to a helmet, the adjustment mechanism comprising: a base configured to be connected to a helmet body of the helmet; and an engagement member connected to the base and defining a seat portion configured for engaging a portion of the facemask, the engagement member slidable with respect to the base to selectively position the seat portion between at least two vertically spaced apart positions relative to the helmet body, the engagement member slidable between the at least two vertically spaced apart positions in a toolless manner to provide adjustment of a vertical position the facemask relative to the helmet body.

In another aspect, there is provided a method of positioning a facemask engaged to a helmet by an adjustment mechanism, the method comprising adjusting a position of at least a portion of the adjustment mechanism in correspondence with a selected position of the facemask, the position of the adjustment mechanism being adjusted in a toolless manner.

In a further aspect, there is provided a method of positioning a facemask of a helmet, the method comprising selecting one of at least two vertically spaced apart positions of the facemask with respect to the helmet, and engaging a portion of the facemask in a selected one of at least two vertically spaced apart seat portions of an adjustment mechanism connected to the helmet, the one of at least two vertically spaced apart seat portions being selected in correspondence with the selected position of the facemask, the portion of the facemask being engaged with the selected one of the at least two vertically spaced apart seat portions in a toolless manner.

DESCRIPTION OF THE DRAWINGS

Reference is now made to the accompanying figures in which.

DETAILED DESCRIPTION

Figure 1:
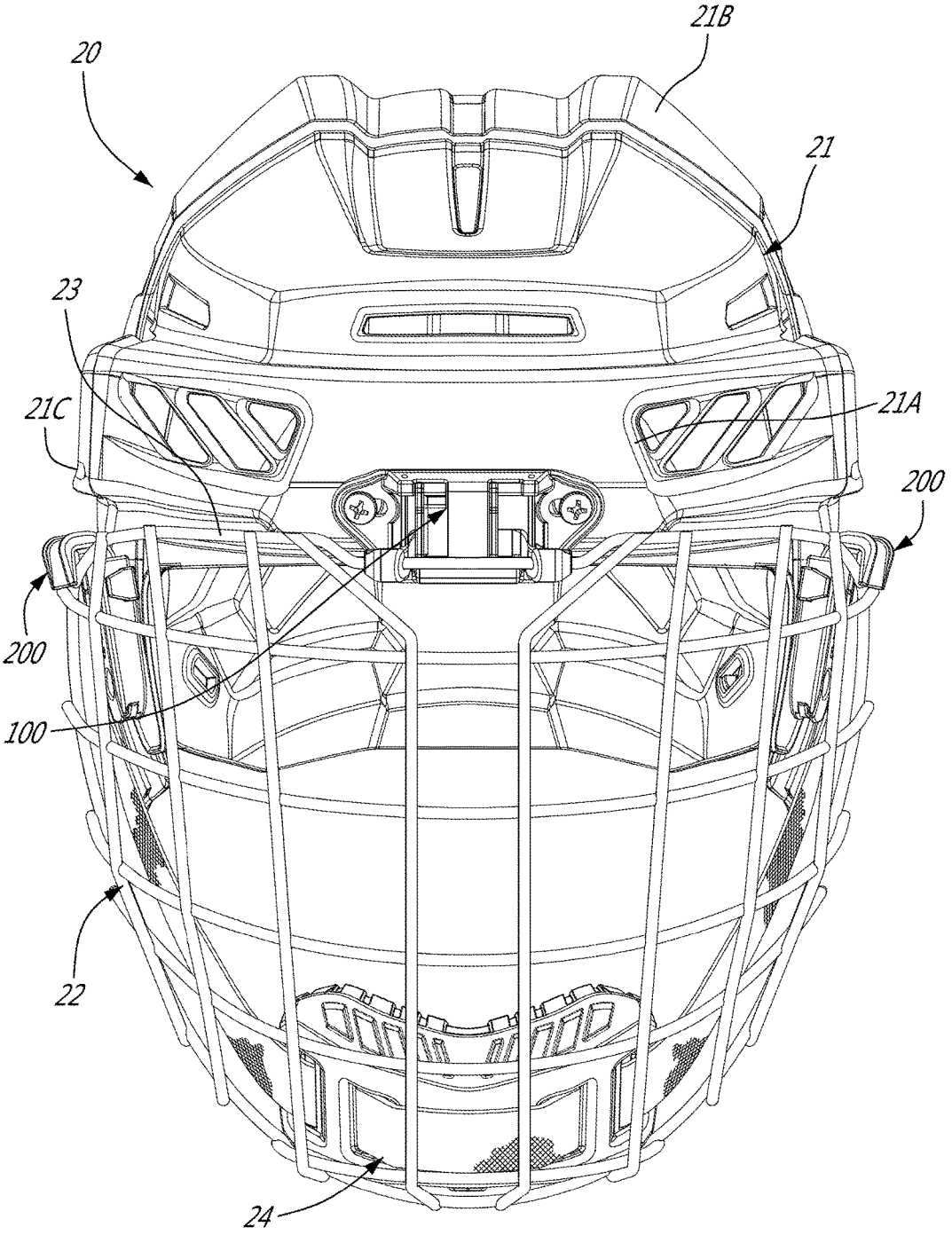
FIG. 1 is a schematic tridimensional view of a helmet having a facemask and adjustment mechanisms according to particular embodiments of the present disclosure, the facemask being partially shown.
Figure 2:
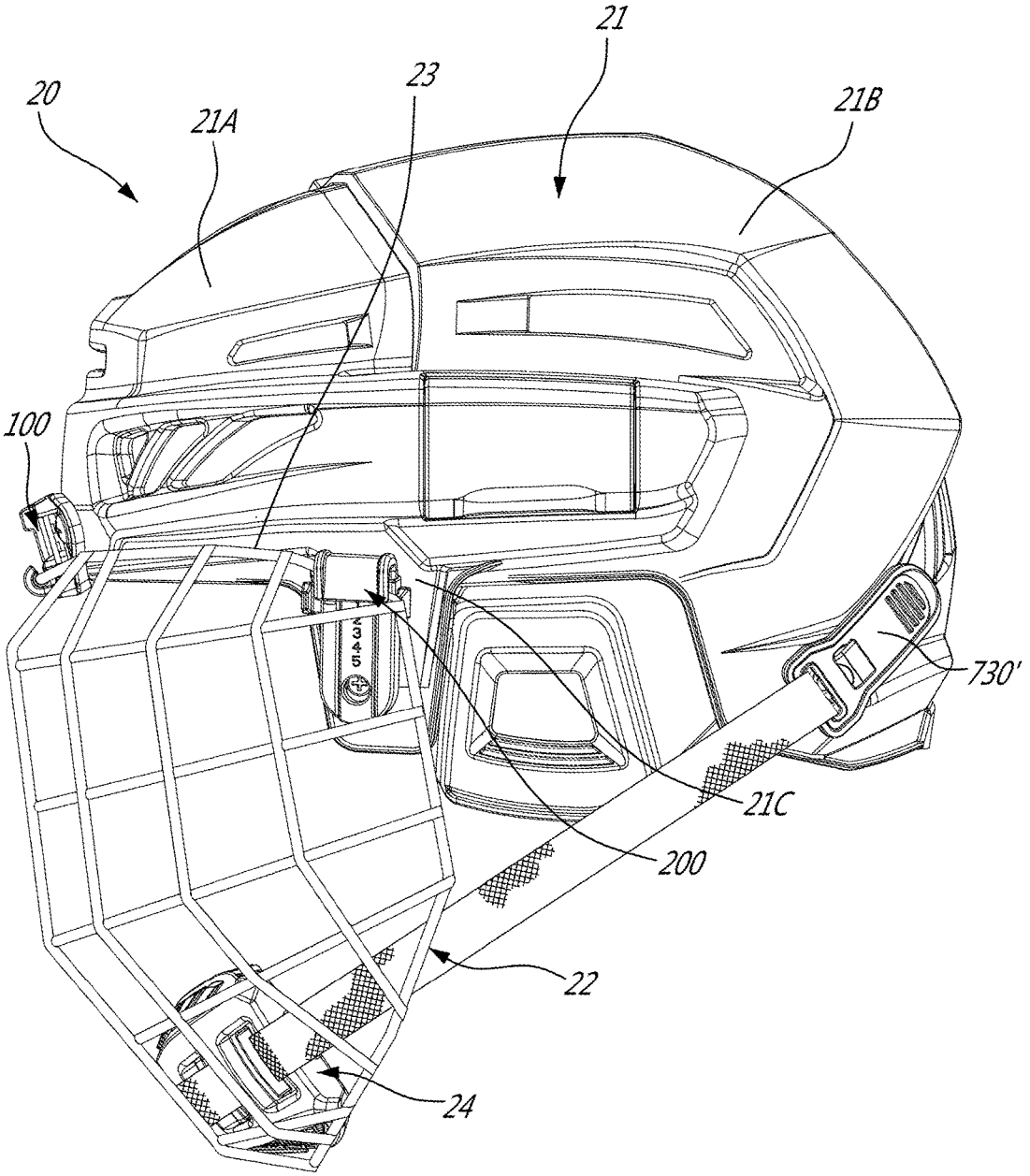
FIG. 2 is a side view of the helmet shown in FIG. 1.

Referring to FIGS. 1-2, a protective hockey helmet is generally shown at 20. Although the helmet 20 is shown and described as a hockey helmet, it is understood that the helmet 20 can alternately be any other type of protective helmet, including but not limited to a lacrosse helmet, a baseball helmet, a football helmet, and a military helmet.

In the embodiment shown, the helmet 20 has a helmet body 21 which covers the head of the wearer when the helmet 20 is worn. The helmet body 21 has a front portion 21A configured to cover and protect a corresponding front portion of the head of the wearer, and a rear portion 21B configured to cover and protect a corresponding rear portion of the head. The helmet body 21 also has two side portions 21C configured to cover and protect corresponding side portions of the head.

The helmet 20 includes a facemask 22 extending from and positioned below the front portion 21A, and generally extends towards the side portions 21C, for covering the face of the wearer. The facemask 22 is adapted to protect some or all of the face of the wearer when the helmet is worn.

In the embodiment shown, the facemask 22 is a wire grid face protector and is substantially adapted to protect the face of the wearer including the chin. In the embodiment shown, the facemask 22 include a protective chin cup 24 along its lower portion. The facemask 22 has a portion 23 adapted to be mounted on to the helmet body 21. In the embodiment shown, the portion 23 includes a wire of the grid of the facemask 22. Alternatively, the facemask can be a visor or any other protective shield.

The facemask 22 is mounted and secured to the helmet body 21 via front and side clips 100, 200 each configured as an adjustment mechanism. Each clip 100, 200 allows adjustment of the position of the facemask 22 relative to the helmet body 21 by the wearer using only his/her fingers or hands without the need to use tools. In the embodiment shown, one front clip 100 is mounted to the front portion 21A and a side clip 200 is mounted to each of the side portions 21C.

As will be further detailed below, the adjustment mechanisms of the clips 100, 200 allow the adjustment of the position of the facemask 21 relative to the helmet body 21 between positions which are vertically spaced apart. It is understood that in the present specification, including claims, the terms "vertical", "vertically" and related terms refer to a vertical or generally vertical direction when the helmet is worn and the wearer is standing upright, and are intended to include any movement sufficiently vertical such as to allow the height of the facemask relative to the face of the wearer to be varied. Adjustment in other directions is also possible, as will be also further detailed below.

Figure 3:
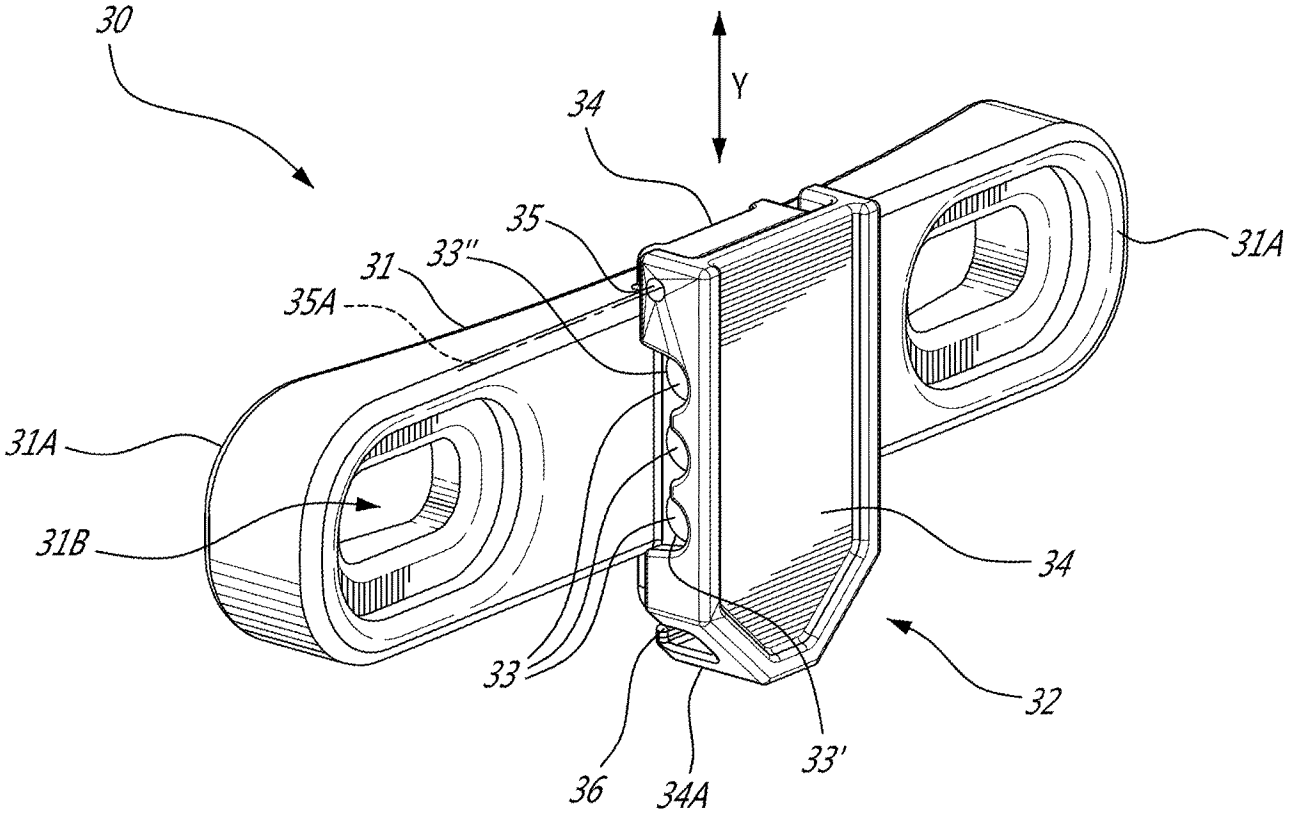
FIG. 3 is a schematic tridimensional view of one of the adjustment mechanisms shown in FIG. 1.

FIG. 3 illustrates an adjustment mechanism 30 in accordance with a particular embodiment, which is particularly suitable to be used as the front clip 100 on the front portion 21A of the helmet body 21 to allow the height of the facemask 22 with respect to the face of the wearer to be adjustable.

The adjustment mechanism 30 includes a base 31 defining two lugs 31A and an engagement member 32. In the embodiment shown, the base 31 can connect to, and can be removed from, the helmet body 21 (FIGS. 1-2) via a fastener disposed through an aperture 31B of each lug 31A. The base 31 can be a bracket or other body having a first surface contacting the helmet body 21, and an opposite second surface facing away from the helmet body 21. For example, the base 31 can be a planar bracket.

Alternatively, the base 31 can be mounted and/or attached to the helmet body 21 via other types of connections. For example, the base 31 can include a member sized to snugly engage a corresponding aperture of the helmet body 21. The base 31 can also be glued, adhered or welded to the helmet body 21. In an alternate embodiment, the base 31 can be integrally molded to the helmet body 21.

The engagement member 32 can be any structure or device used for securing the facemask 22 to the adjusting mechanism 30. The engagement member 32 defines two or more vertically spaced apart seat portions 33 each configured for receiving the same portion 23 of the facemask 22 (FIGS. 1-2). In the embodiment shown, the engagement member 32 includes three longitudinal seat portions 33 disposed along the base 31. The seat portions 33 are disposed substantially parallel from one another and spaced along the vertical direction Y. The seat portions 33 can have any shape adapted to receive the facemask portion 23. For example, in the embodiment shown, each seat portion 33 has a slot defined therein and sized to receive the wire (facemask portion 23) of the facemask 22. The facemask 22 can be selectively positioned via engagement of the facemask portion 23 with a selected one of the seat portions 33, thus positioning the facemask 22 relative to the base 31 along a vertical direction Y over the face of the wearer. Advantageously, the facemask 22 can be adjusted to fit the face of the wearer.

The facemask portion 23 is engageable in and removable from the seat portions 33 in a toolless manner. The position of the facemask 22 is adjusted with respect to the base 31, and thus with respect to the helmet body 21, by selecting one of the seat portions 33 for engagement with the facemask portion 23. For example, a lower position of the facemask 22 is provided when the facemask portion 23 is engaged with the lower seat portion 33', and a higher position of the facemask 22 is provided when the facemask portion 23 is engaged with the upper seat portion 33".

A movable cover 34 defining a resilient tongue 34A is provided to secure the facemask portion 23 within the selected seat portion 33. The cover 34 is manually displaceable between a secured position and an exposed position. In FIG. 3, the cover 34 is shown in the secured position, where the cover 34 is engaged to the engagement member 32 and cooperates with the engagement member 32 to close the slots of the seat portions 33 and enclose the facemask portion 23. In the unsecured position, the cover 34 is positioned away from the seat portions 33 to allow access to the slots defined therein, for insertion or removal of the facemask portion 23 (e.g. wire).

In the embodiment shown, the cover 34 is connected to the engagement member 32 via a hinge 35. The hinge 35 defines a hinge axis 35A which in the embodiment shown is horizontal or substantially horizontal; other orientations are of course possible. In operation, the cover 34 is rotated about the hinge axis 35A toward the base 31 in order to engage the engagement member 32 in the secured position. The cover 34 is rotated about the hinge axis 35A away from the base 31 in order to expose the engagement member 32 and the seat portions 33, in the exposed position. The resilient tongue 34A snugly engages over an edge 36 of the engagement member 32 to lock the cover 34 in the secured position. Manipulation of the cover 34 can be performed manually, i.e. in a toolless manner.

It is understood that the cover 34 can be connected to the engagement member 32 and/or base 31 in any other suitable configuration, and can also be completely removable from the engagement member 32 and base 31 in the exposed position.

Figure 4:
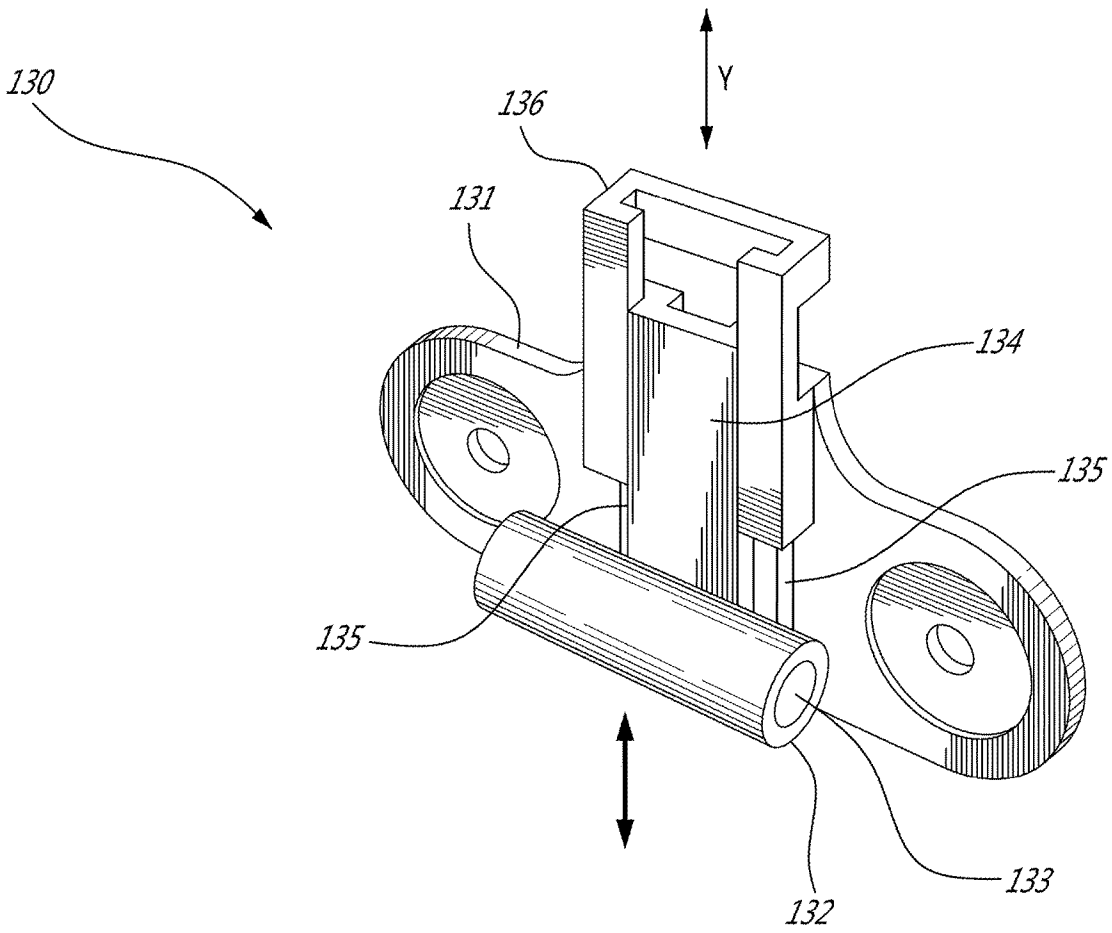
FIG. 4 is a schematic tridimensional view of an adjustment mechanism, according to another embodiment of the present disclosure.

Referring to FIG. 4, an adjustment mechanism 130 in accordance with another particular embodiment is shown, which is also particularly suitable to be used as the front clip 100 on the front portion 21A of the helmet body 21 to allow the height of the facemask 22 with respect to the face of the wearer to be adjustable. The adjustment mechanism 130 includes a base 131 and an engagement member 132. The base 131 is configured to be engaged to the helmet body 21, e.g. in a fixed position.

The engagement member 132 defines a seat portion 133 for receiving the facemask portion 23. The seat portion 133 can have any shape adapted to receive the facemask portion 23. For example, in the embodiment shown, the seat portion 133 has a slot defined therein sized to receive the portion of the wire of the facemask 22. The engagement member 132 slides along the vertical direction Y with respect to the base 131 and can be selectively positioned in one of two or more vertically spaced apart positions relative to the base 131. The facemask 22 can thus be positioned relative to the helmet body 21 through sliding of the engagement member 132 by the wearer using only his/her fingers or hands without the need to use tools and without having to remove the facemask 22 from the helmet body 21.

The engagement member 132 includes a movable portion 134 extending from the seat portion 133. Although in the embodiment shown the movable portion 134 has a planar shape, other shapes and/or configurations are also possible. The movable portion 134 includes two elongated tongues 135 along its opposite sides surfaces, which are received in two opposite complementary grooves 136 of the base 131 extending in the vertical direction Y. The tongues 135 slide within the grooves 136 to provide continuous sliding adjustments of the position of the engagement member 132 with respect to the base 131. Other configurations allowing any adequate type of relative movement between the engagement member 132 and the base 131 are also possible, including, but not limited to, configurations allowing a relative sliding movement, configurations allowing a relative rotational movement and configurations allowing a relative hinged movement.

The movable portion 134 can be locked in position relative to the base 131 by any suitable type of locking mechanism.

Figure 5:
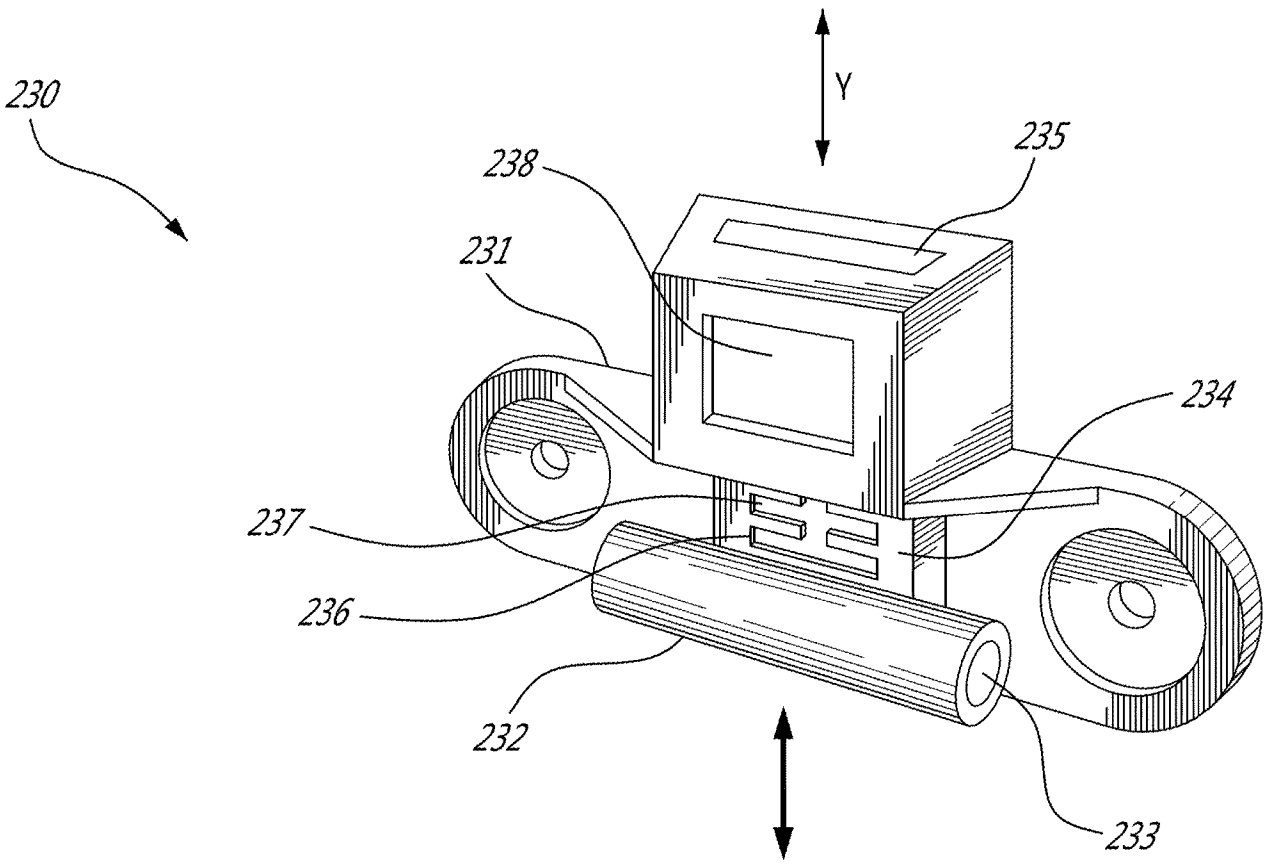
FIG. 5 is a schematic tridimensional view of an adjustment mechanism, according to another embodiment of the present disclosure.

Referring to FIG. 5, an adjustment mechanism 230 in accordance with another particular embodiment is shown, which is also particularly suitable to be used as the front clip 100 on the front portion 21A of the helmet body 21 to allow the height of the facemask 22 with respect to the face of the wearer to be adjustable.

The adjustment mechanism 230 includes a base 231 configured to be engaged to the helmet body 21 (e.g. in a fixed position) and an engagement member 232. The engagement member 232 defines a seat portion 233 for receiving the facemask portion 23 which can have any shape adapted to receive the facemask portion 23, including for example a slot to receive the wire of the facemask 22. The engagement member 232 slides vertically with respect to the base 231 and can be selectively positioned in one of two or more vertically spaced apart positions relative to the base 231. The facemask 22 can thus be positioned relative to the helmet body 21 through sliding of the engagement member 232 by the wearer using only his/her fingers or hands without the need to use tools and without having to remove the facemask 22 from the helmet body 21.

The engagement member 232 includes a movable portion 234 extending away from the seat portion 233. Although in the embodiment shown the movable portion 234 has a planar shape, other shapes and/or configurations are also possible. The base 231 has a base slot 235 defined therein extending in the vertical direction Y, complementary to the movable portion 234. The movable portion 234 slides within the base slot 235 to provide sliding adjustments of the position of the engagement member 232 with respect to the base 231. Other configurations allowing any adequate type of relative movement between the engagement member 232 and the base 231 are also possible, including, but not limited to, configurations allowing a relative sliding movement, configurations allowing a relative rotational movement and configurations allowing a relative hinged movement.

The engagement member 232 can be locked in position relative to the base 231 by any suitable type of locking mechanism. In the embodiment shown, the movable portion 234 includes a plurality of recesses 236. A finger 237 of the locking mechanism extends from the base 231 and is resiliently biased towards engagement in one of the recesses 236. To adjust the position of the engagement member 232, a push-button 238 is pressed to move the finger 237 toward the base 231 and out of the recess 236 to allow varying the relative position between the engagement member 232 and the base 231. The engagement member 232 can thus slide between discrete positions defined by the engagement of the finger 237 in each of the recesses 236.

Figure 6:
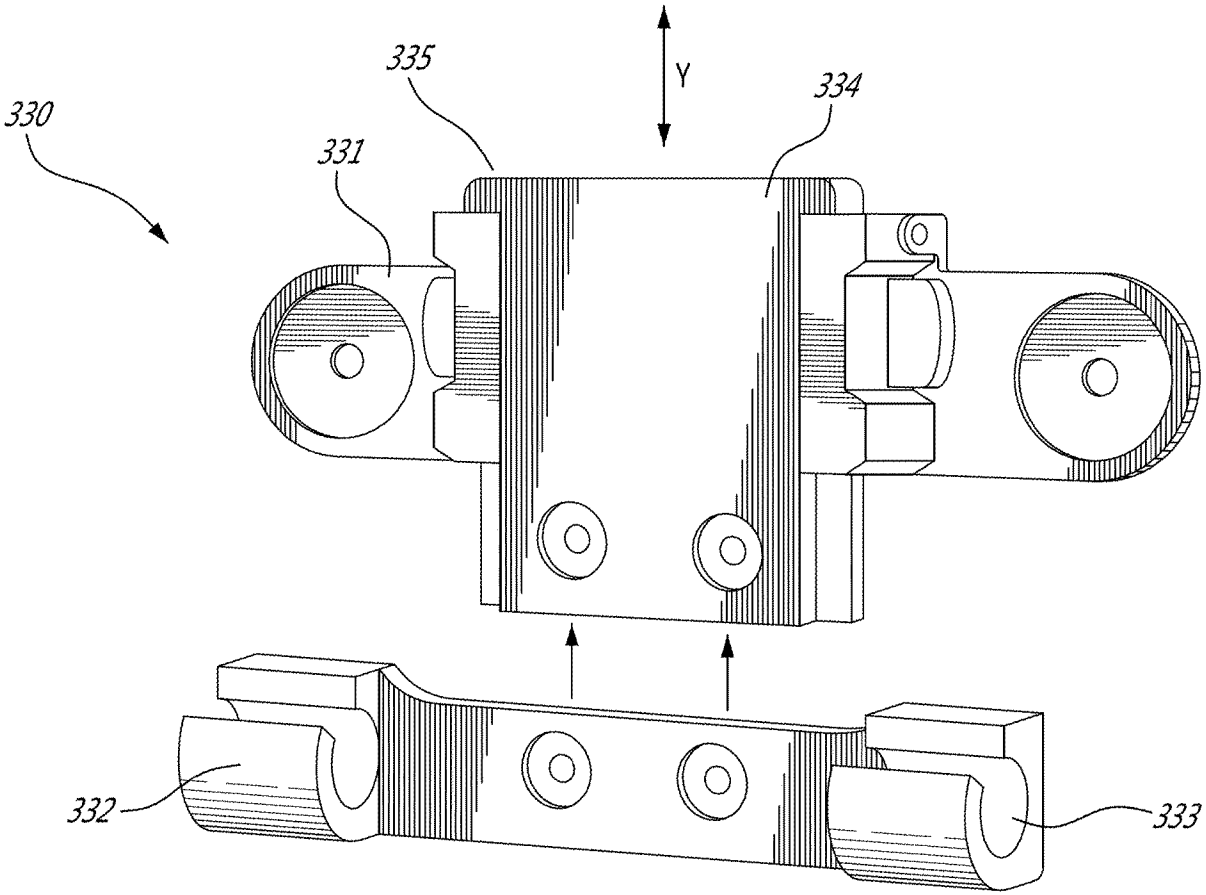
FIG. 6 is a schematic tridimensional view of an adjustment mechanism, according to another embodiment of the present disclosure.

Referring to FIG. 6, an adjustment mechanism 330 in accordance with another particular embodiment is shown, which is also particularly suitable to be used as the front clip 100 on the front portion 21A of the helmet body 21 to allow the height of the facemask 22 with respect to the face of the wearer to be adjustable.

The adjustment mechanism 330 includes a base 331 configured to be engaged to the helmet body 21 (e.g. in a fixed position) and an engagement member 332. The engagement member 332 defines a seat portion 333 for receiving the facemask portion 23, which can have any shape adapted to receive the facemask portion 23, including for example a slot to receive the wire of the facemask 22. The engagement member 332 slides vertically with respect to the base 331 and can be selectively positioned in one of two or more vertically spaced apart positions relative to the base 331. The facemask 22 can thus be positioned relative to the helmet body 21 through sliding of the engagement member 332 by the wearer using only his/her fingers or hands without the need to use tools and without having to remove the facemask 22 from the helmet body 21.

The engagement member 332 includes a movable portion 334 slidable with respect to the base 331 in the vertical direction Y. The movable portion 334 (shown here separate from the seat portion 333) is connected to the seat portion 333 via fasteners, or through any other suitable type of connection. The base 331 defines an opening 335 for receiving the movable portion 334. The movable portion 334 slides within the opening 335 to provide discrete sliding adjustments of the position of the engagement member 332 with respect to the base 331. Other configurations allowing any adequate type of relative movement between the engagement member 332 and the base 331 are also possible, including, but not limited to, configurations allowing a relative sliding movement, configurations allowing a relative rotational movement and configurations allowing a relative hinged movement.

The engagement member 332 can be locked in position relative to the base 331 by any suitable type of locking mechanism. For example, the locking mechanism may be a push button operated mechanism similar to that previously described for the adjustment mechanism 230 of FIG. 5. Other configurations are also possible.

Figure 7:
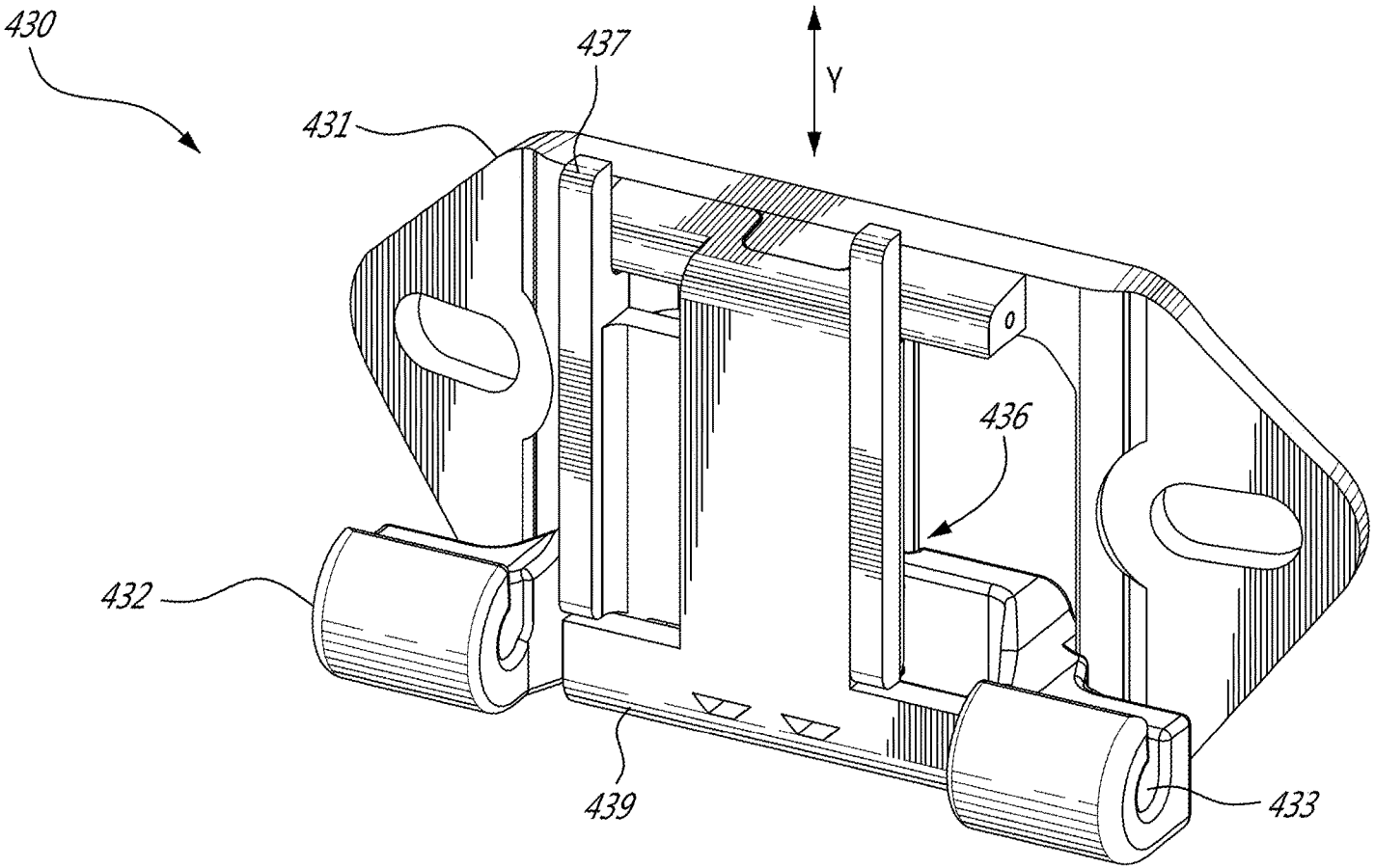
FIGS. 7 and 8 are schematic tridimensional views of an adjustment mechanism, according to another embodiment of the present disclosure.
Figure 8:
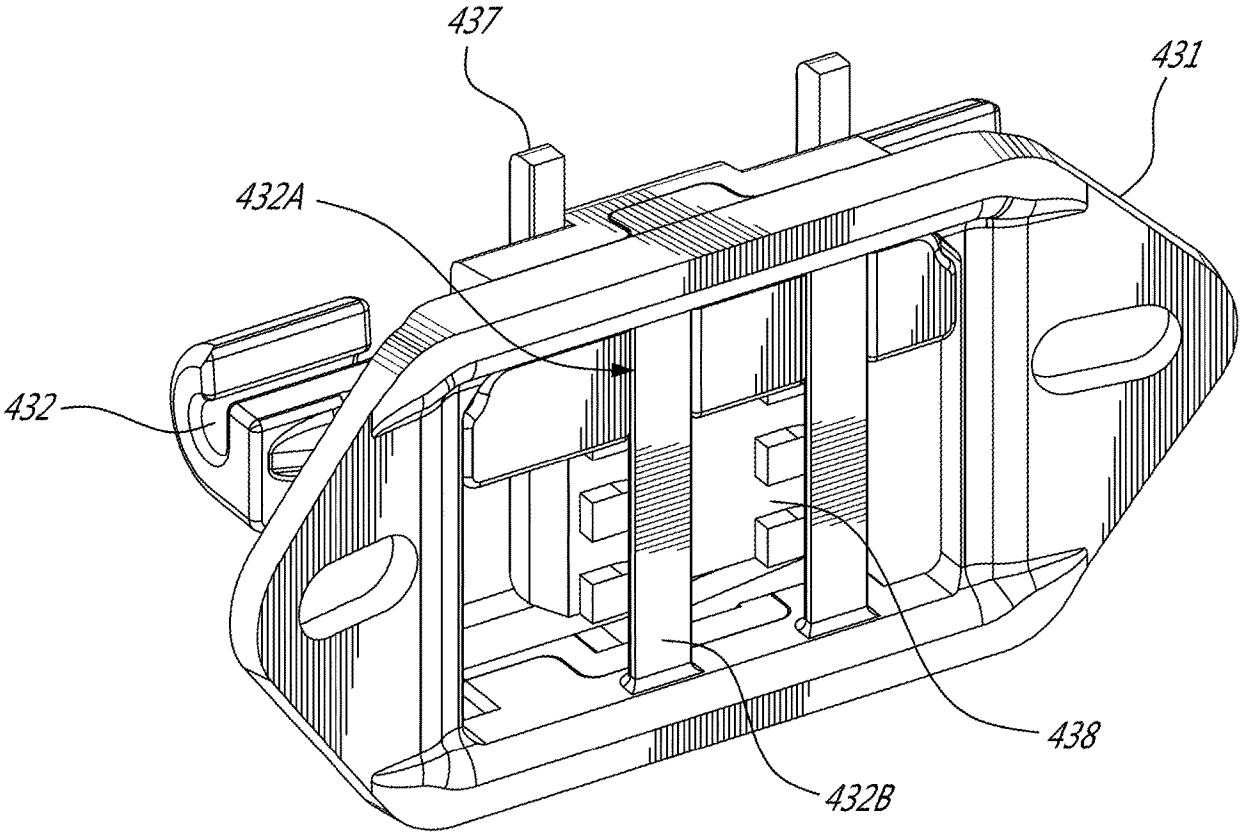
Figure 9:
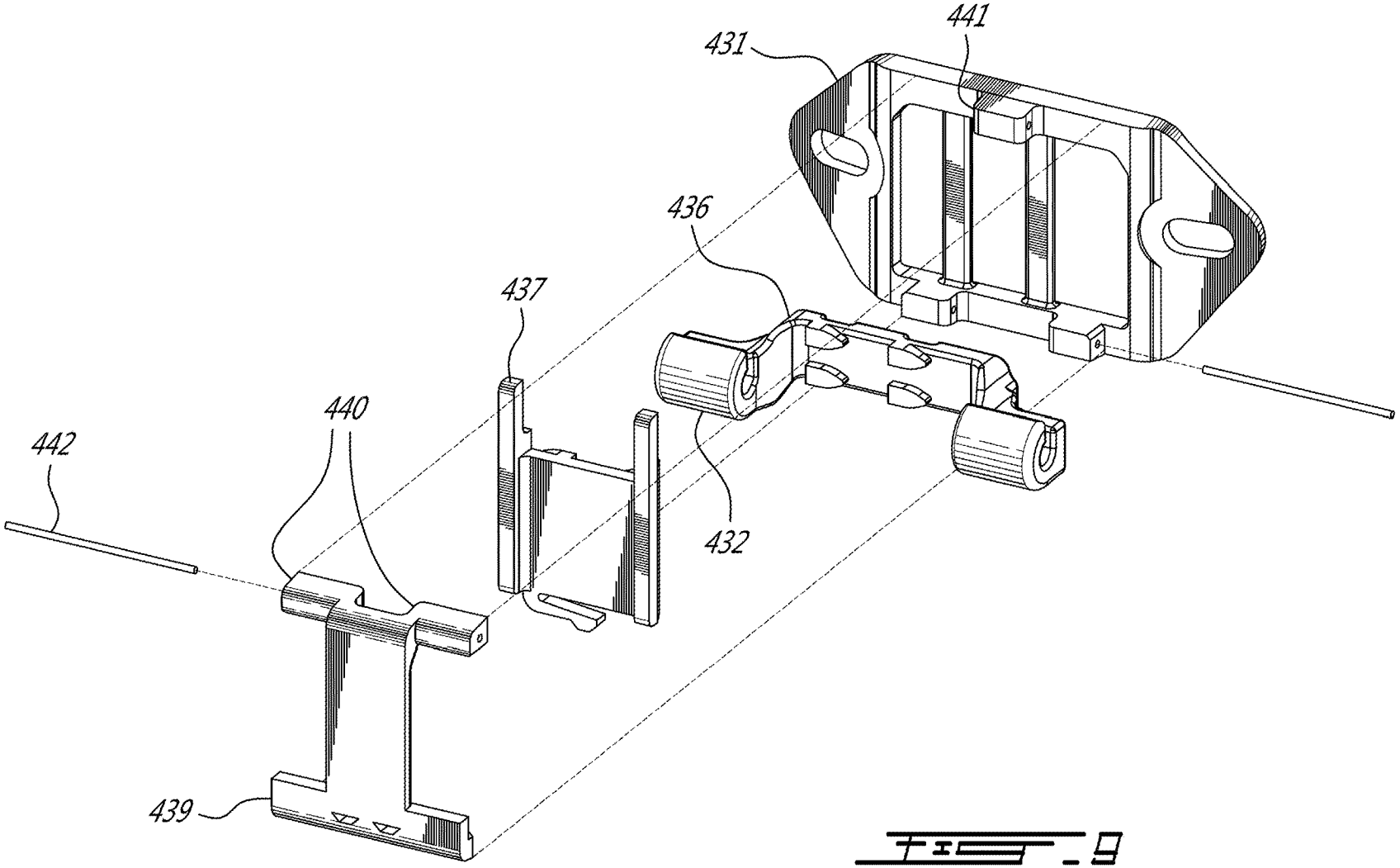
FIG. 9 is a schematic tridimensional exploded view of the adjustment mechanism of FIGS. 7-8.

Referring to FIGS. 7-9, an adjustment mechanism 430 in accordance with another particular embodiment is shown, which is also particularly suitable to be used as the front clip 100 on the front portion 21A of the helmet body 21 to allow the height of the facemask 22 with respect to the face of the wearer to be adjustable.

The adjustment mechanism 430 includes a base 431 configured to be engaged to the helmet body 21 (e.g. in a fixed position) and an engagement member 432. The engagement member 432 defines a seat portion 433 for receiving the facemask portion 23, which can have any shape adapted to receive the facemask portion 23, including for example a slot to receive the wire of the facemask 22. The engagement member 432 slides with respect to the base 431 in the vertical direction Y (FIG. 7) via two recesses 432A (FIG. 8) disposed on an inner surface of the engagement member 432, each engaged with a respective one of two rails 432B of the base 431. The facemask 22 can thus be positioned relative to the helmet body 21 through sliding of the engagement member 432 by the wearer using only his/her fingers or hands without the need to use tools and without having to remove the facemask 22 from the helmet body 21.

The engagement member 432 can be locked in position relative to the base 431 by any suitable type of locking mechanism. In the embodiment shown, the engagement member 432 includes vertically spaced sets of locking teeth 436 (FIG. 9) on its outer surface. A locking member 437 is operable between an engaged position and a disengaged position. The locking member 437 defines guide slots 438 (FIG. 8) on its inner surface, facing the outer surface of the engagement member 432, for engaging the locking teeth 436.

The locking member 437 is secured to the base 431 and slidable with respect thereto transversely to the movement between the engagement member 432 and the base 431, i.e. in a "side to side" direction, between the engaged and disengaged positions. A cover 439 engaged to the base 431 retains the locking member 437 and abuts a respective edge of the locking member 437 in the engaged and disengaged positions; the cover 439 cooperates with the base 431 to retain the locking member 437 and limits the side to side movement of the locking member 437 to define the engaged and disengaged positions.

In the embodiment shown, and as can be seen more clearly in FIG. 9, the cover 439 includes two spaced apart top tabs having aligned openings 440 defined therethrough. A central tab of the base 431 has a corresponding opening 441 defined therethrough. The tab of the base 431 is received between the tabs of the cover 439 and a pin 442 is inserted in the aligned openings 440, 441 to interconnect the cover 439 and base 431. The bottom of the cover 439 is also similarly connected to the base by another pin. Other configurations are also possible. For example, the base 431 and the cover 439 may be formed as a single piece.

In the engaged position, the guide slots 438 of the locking member 437 are engaged with the locking teeth 436 of the engagement member 432 to lock the relative position between the engagement member 432 and the base 431. The locking teeth 436 may have a tapered end to facilitate the engagement with the guide slots 438. In the disengaged position, the guide slots 438 are positioned away from the locking teeth 436 to allow the relative position between the engagement member 432 and the base 431.

In another embodiment, the base 431 may be omitted and/or be formed as a part of the helmet body 21. For example, rails 432B can be mounted on the helmet body 21 and engaged with the two recesses 432A of the engagement member 432.

Figure 10:
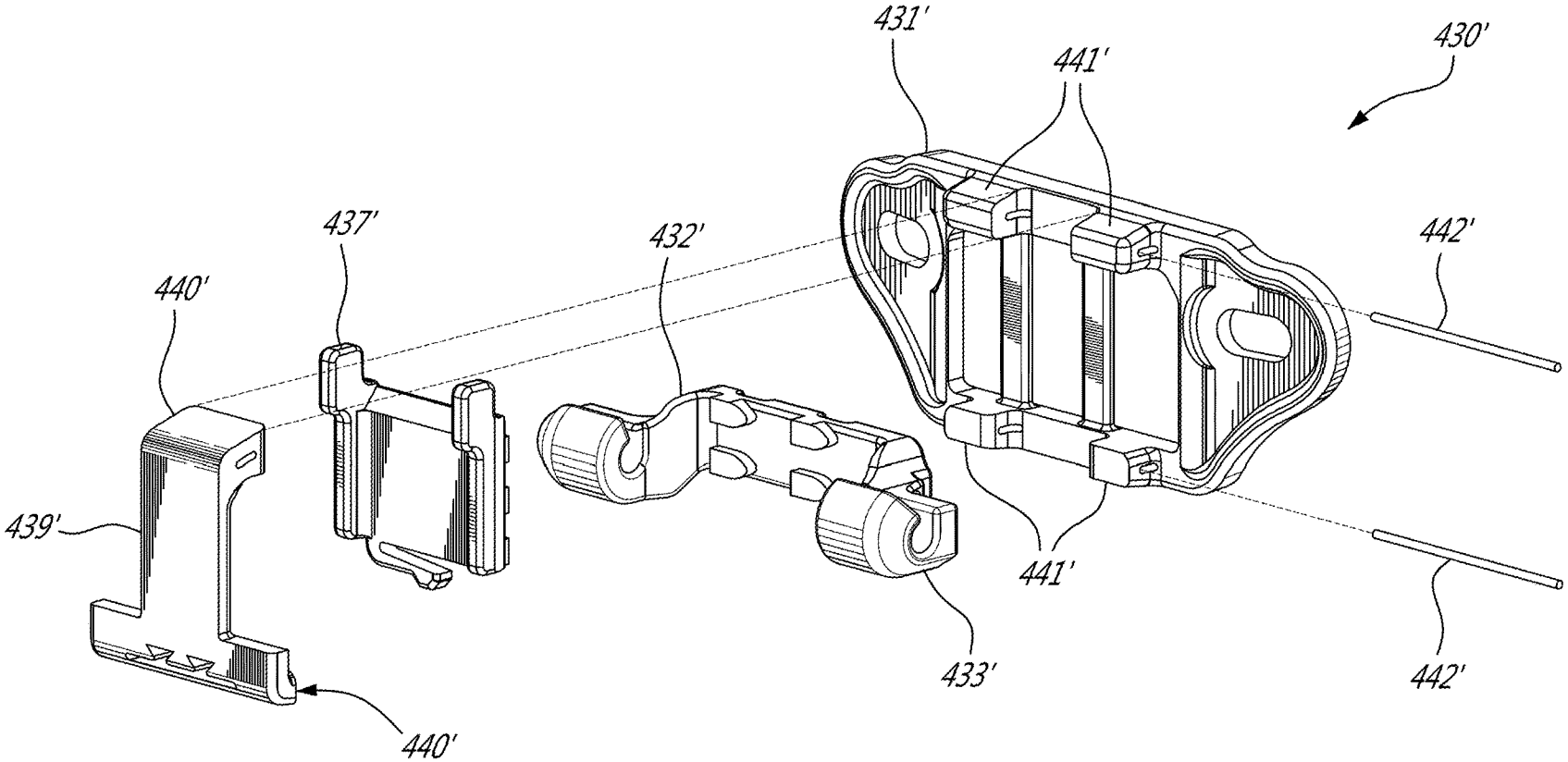
FIG. 10 is a schematic tridimensional exploded view of an adjustment mechanism, according to another embodiment of the present disclosure.

Referring to FIG. 10, an adjustment mechanism 430' in accordance with an alternate embodiment is shown, which is also particularly suitable to be used as the front clip 100 on the front portion 21A of the helmet body 21 to allow the height of the facemask 22 with respect to the face of the wearer to be adjustable. The operation of the adjustment mechanism 430' for positioning the facemask 22 relative to the helmet body 21 is similar to the operation of the adjustment mechanism 430 described above.

The adjustment mechanism 430' includes a base 431' configured to be engaged to the helmet body 21 (e.g. in a fixed position) and an engagement member 432'. The engagement member 432' defines a seat portion 433' for receiving the facemask portion 23, which can have any shape adapted to receive the facemask portion 23, including for example a slot to receive the wire of the facemask 22. The engagement member 432' is vertically slidable with respect to the base 431' through a rail engagement, similarly to the embodiment of FIG. 9.

The adjustment mechanism 430' also includes a cover 439' and a locking member 437' to lock the engagement member 432' in position relative to the base 431'. The locking member 437' is slidable with respect to the base 431' and abuttable to the cover 439' similarly to the locking member 437 of FIG. 9.

In this embodiment, the cover 439' has a central top tab having an opening 440' defined therethrough. Two spaced apart tabs of the base 431' have corresponding aligned openings 441' defined therethrough. The tab of the cover 439' is received between the tabs of the base 431' and a pin 442' is inserted in the aligned openings 440', 441' to interconnect the cover 439' and base 431'. The bottom of the cover 439' is also similarly connected to the base 431" by another pin.

Figure 11:
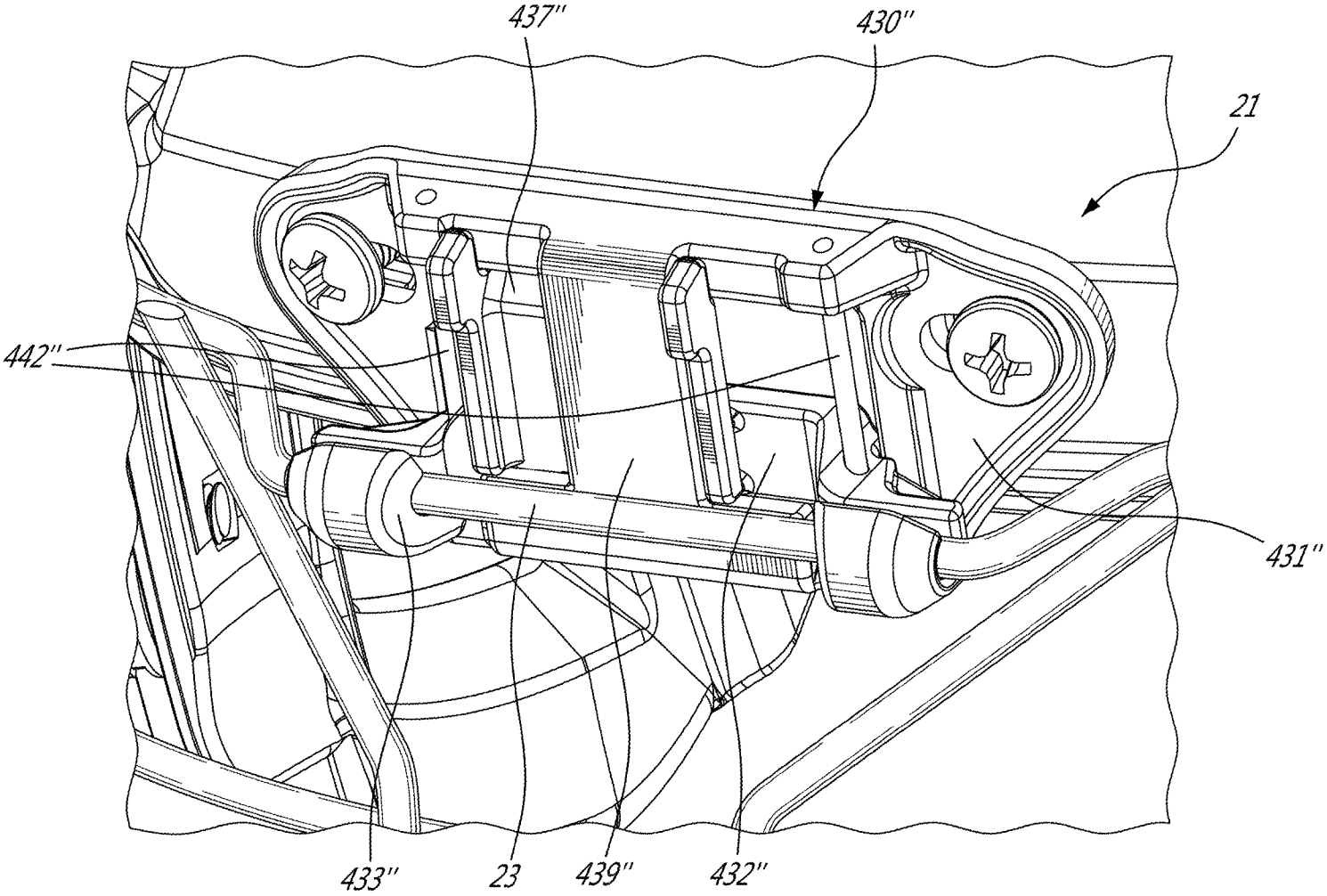
FIG. 11 is a schematic tridimensional view of an adjustment mechanism, according to another embodiment of the present disclosure.

Referring to FIG. 11, an adjustment mechanism 430" in accordance with an alternate embodiment is shown, also similar to the adjustment mechanisms 430, 430' described above, and also particularly suitable to be used as the front clip 100 on the front portion 21A of the helmet body 21 to allow the height of the facemask 22 with respect to the face of the wearer to be adjustable.

The adjustment mechanism 430" includes a base 431" configured to be engaged to the helmet body 21 (e.g. in a fixed position) and an engagement member 432". The engagement member 432" defines a seat portion 433" for receiving the facemask portion 23, which can have any shape adapted to receive the facemask portion 23, including for example a slot to receive the wire of the facemask 22.

In this embodiment, two rods 442" extend vertically between top and bottom protrusions of the base 431", and the engagement member 432" includes openings through which the rods 442" are received. The engagement member 432" is vertically slidable with respect to the base 431" along the rods 442".

The adjustment mechanism 430" also includes a cover 439" and a locking member 437" to lock the engagement member 432" in position relative to the base 431". The locking member 437" is slidable with respect to the base 431" and abuttable to the cover 439" similarly to the locking member 437 of FIG. 9. In this embodiment however, the cover 439" is integral with the base 431".

Figure 12A:
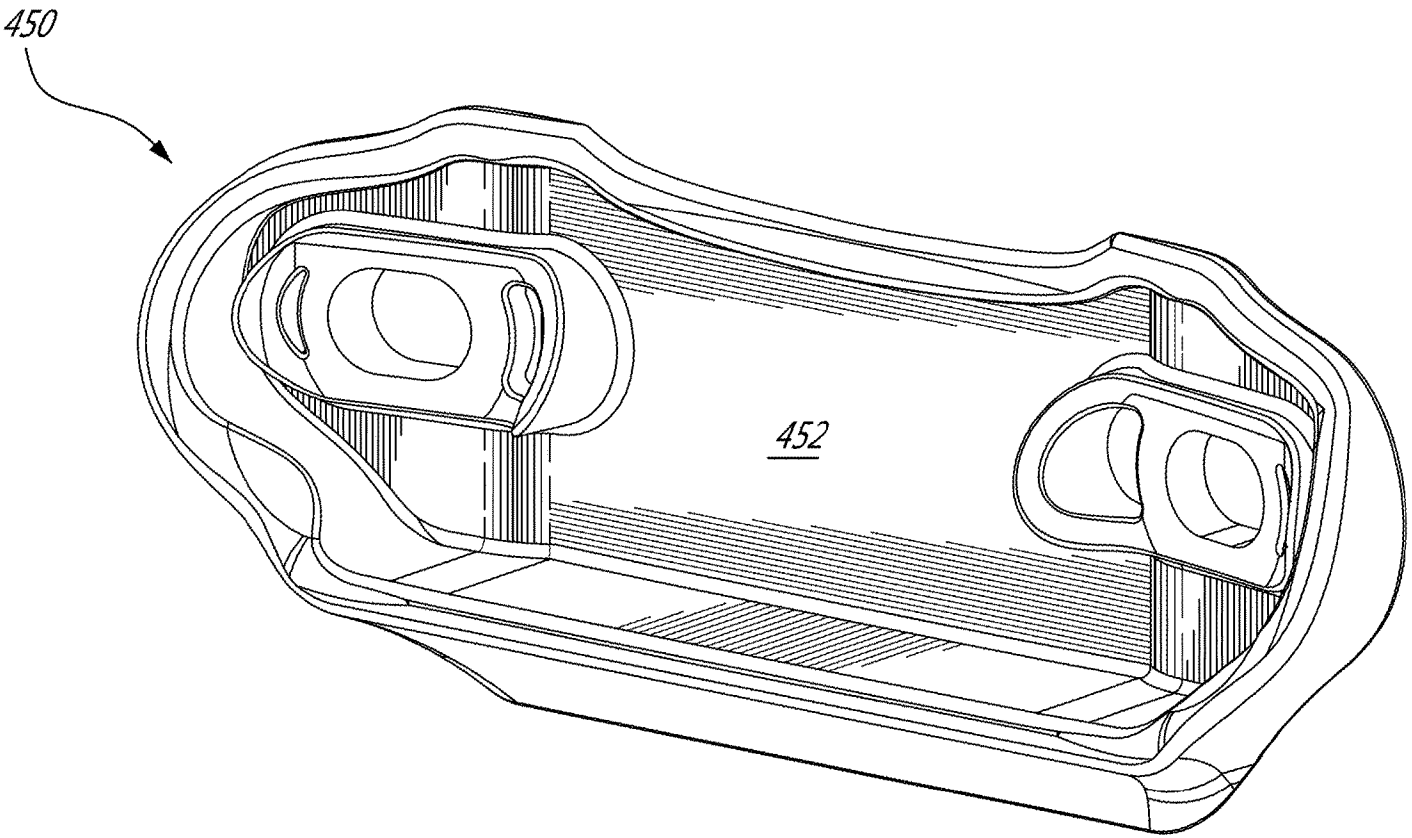
FIGS. 12A-12B are schematic tridimensional views of a spacer, according to an embodiment of the present disclosure.
Figure 12B:
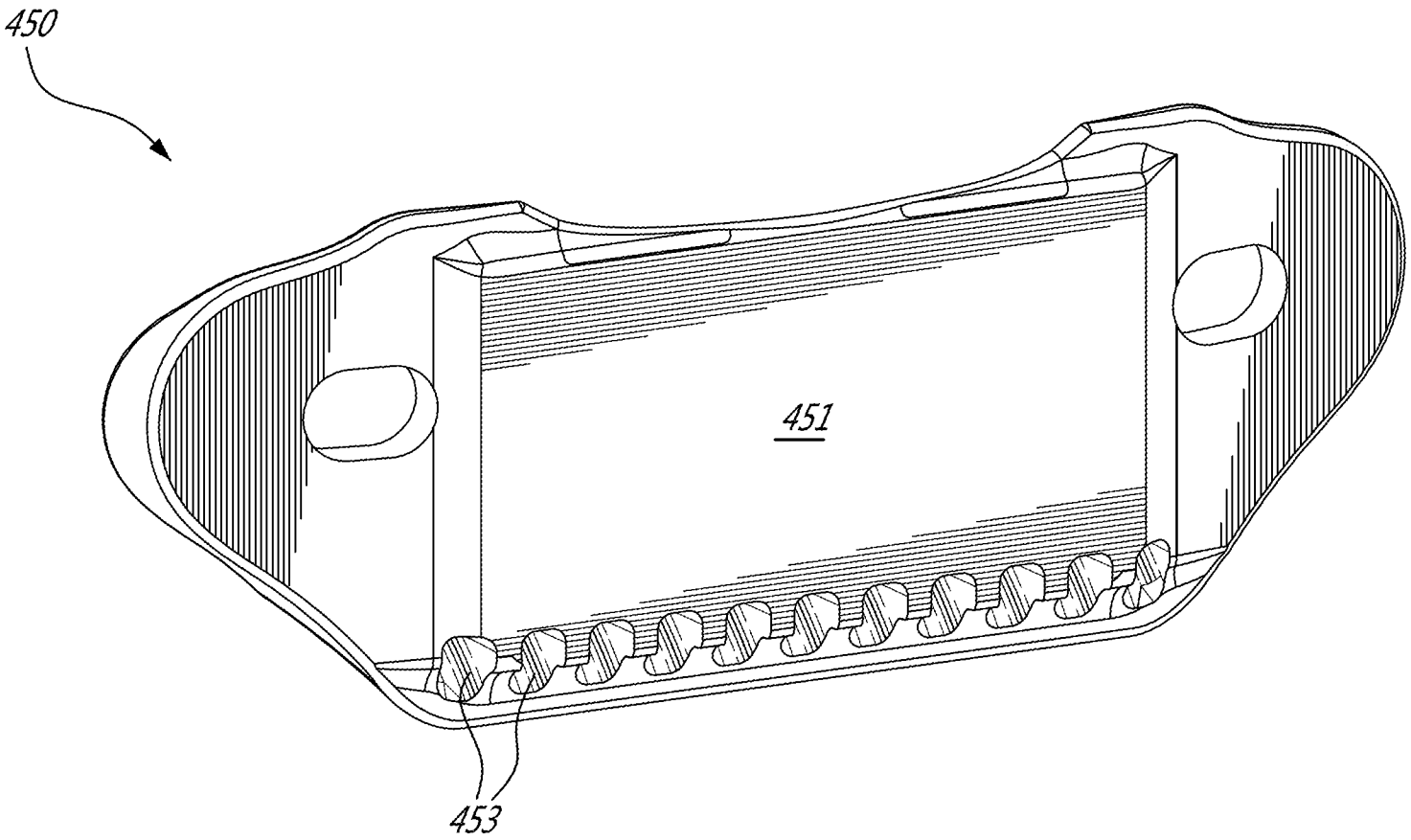

Referring to FIGS. 12A-12B, a spacer 450 in accordance with an embodiment is shown. The spacer 450 can be used to mount any one of the front clip 100 adjustment mechanisms, for example adjustment mechanisms 430, 430' and 430", at a distance from the helmet body 21. In use, the spacer 450 engages the helmet body 21 via a rear surface 451 and receives the front clip 100 in abutment with an opposed front surface 452. In the embodiment shown, the spacer 450 is formed as a molded part and includes multiple holes 453 (FIG. 12) which may facilitate the molding process; other configurations are also possible.

Figure 13:
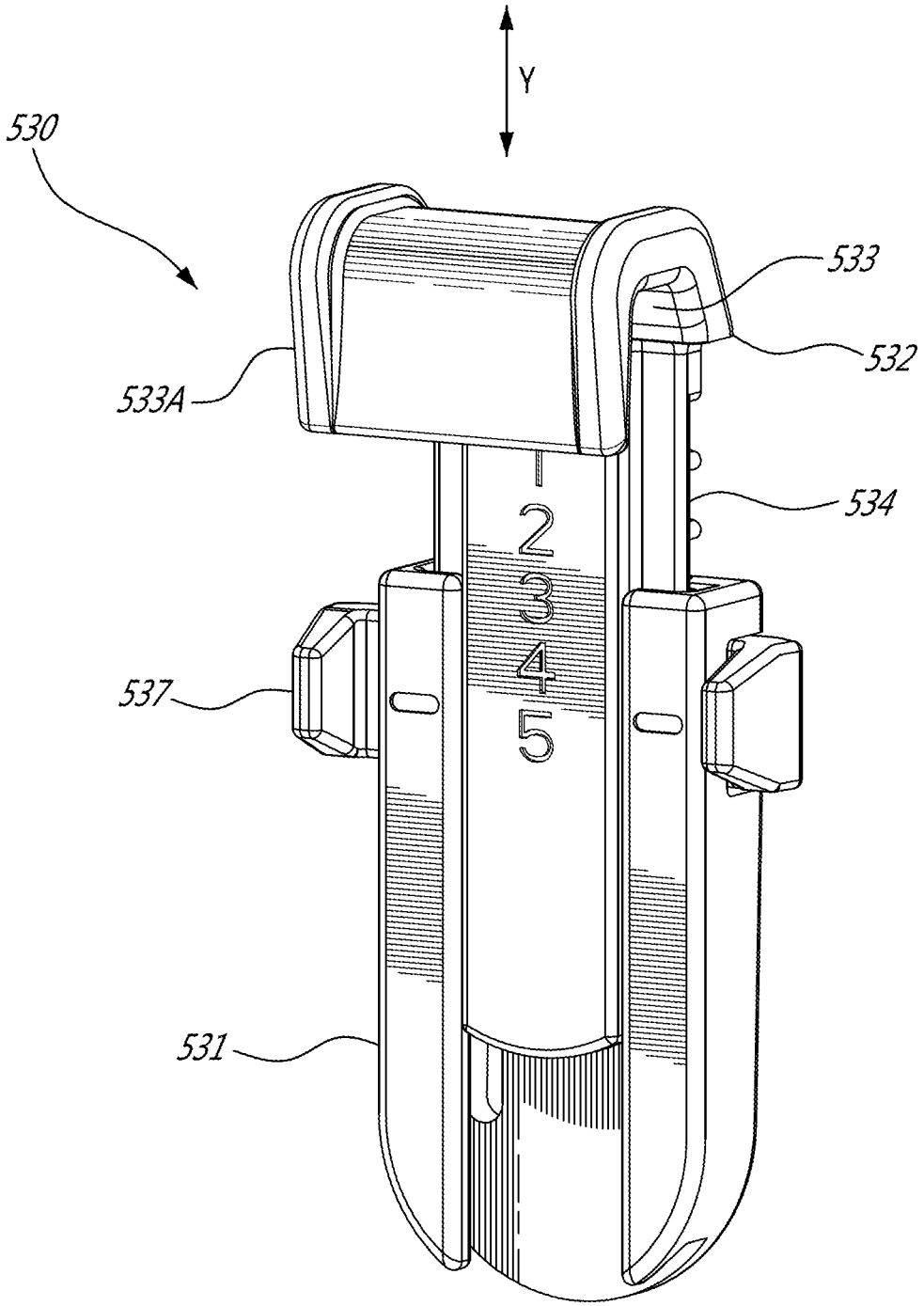
FIG. 13 is a schematic tridimensional views of another one of the adjustment mechanisms shown in FIG. 1.
Figure 14:
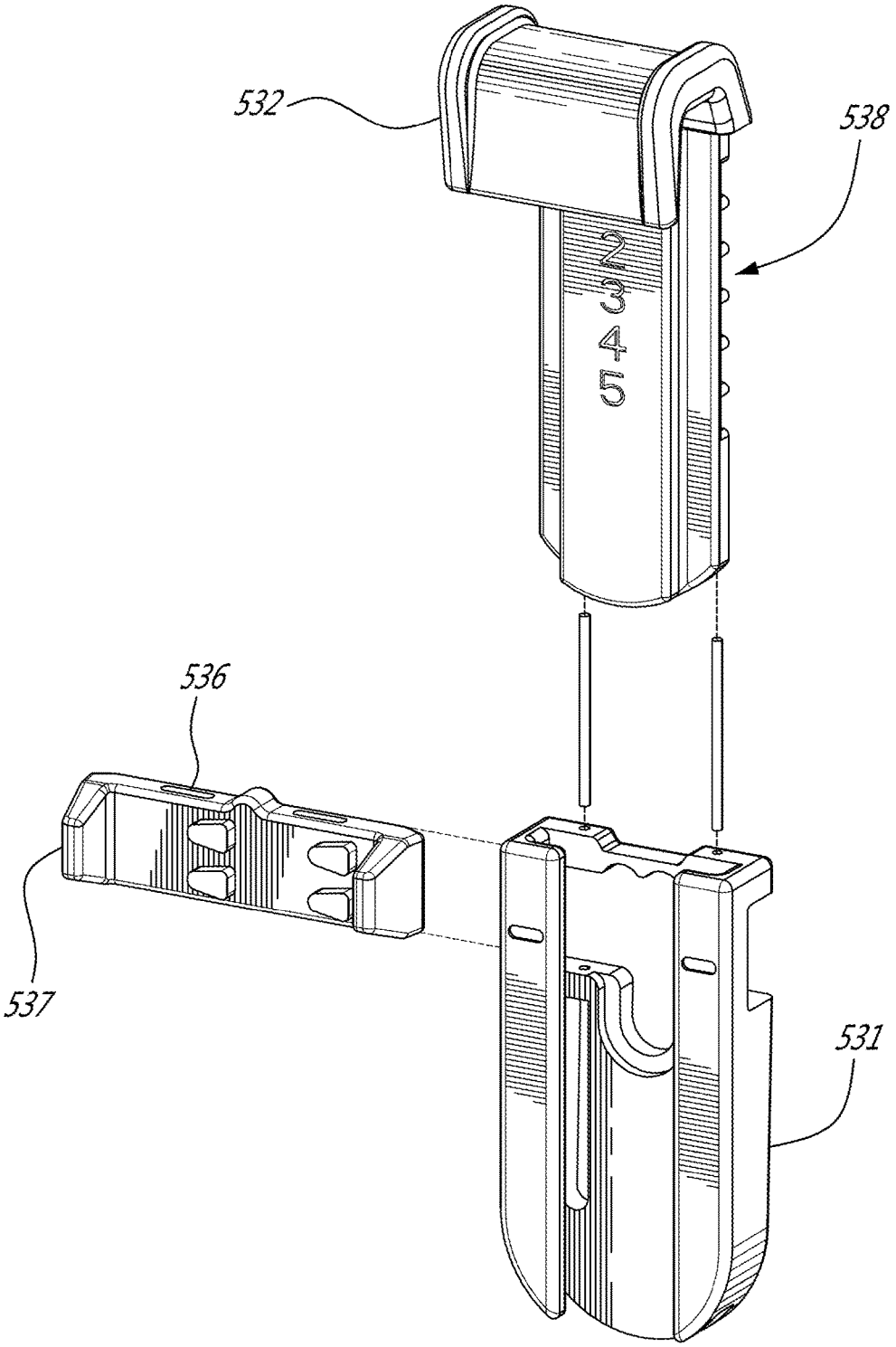
FIGS. 14-15 are schematic tridimensional exploded views of the adjustment mechanism of FIG. 13.
Figure 15:
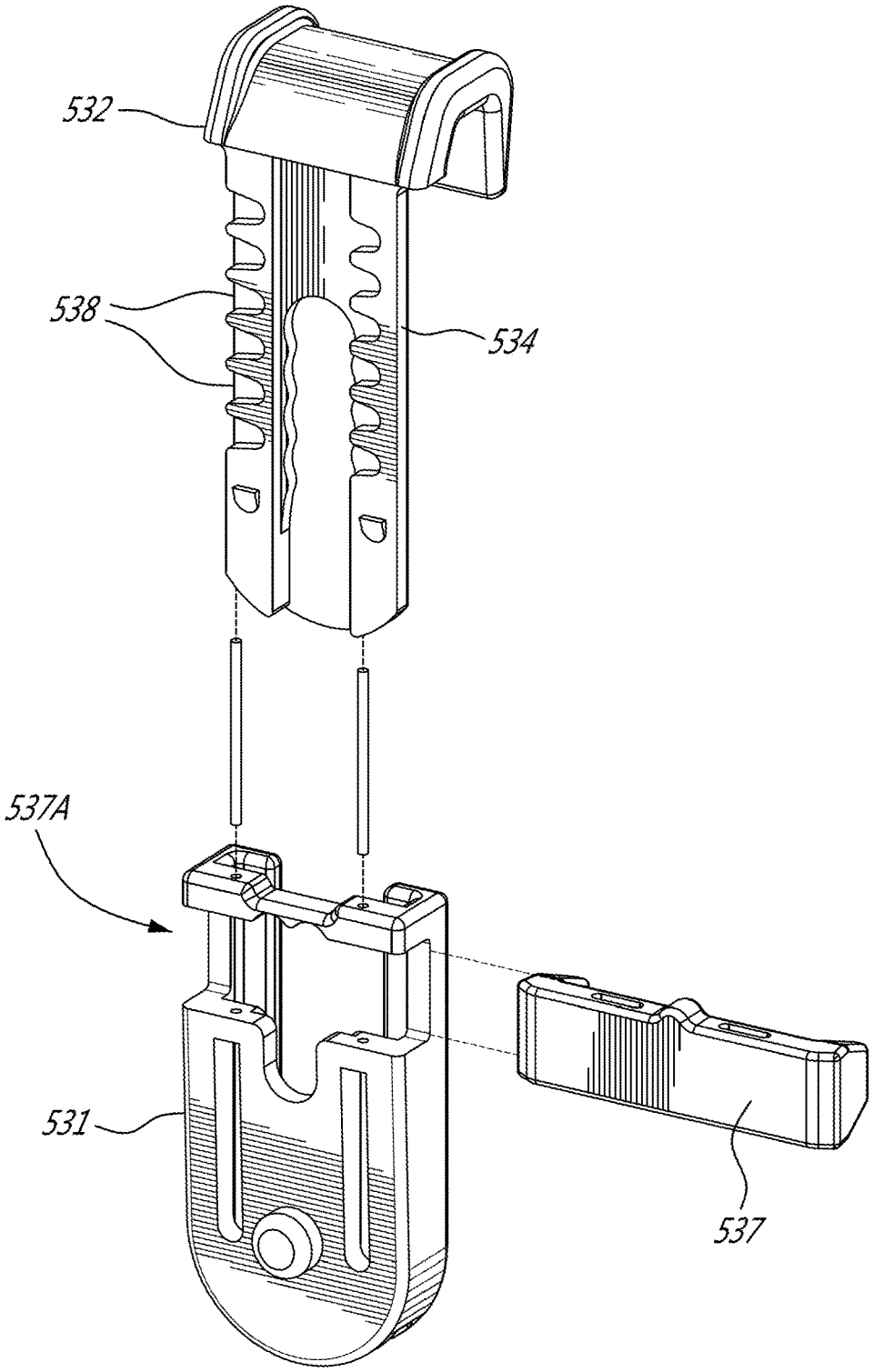

Referring to FIGS. 13-15, an adjustment mechanism 530 according to another particular embodiment is shown, which is particularly suitable to be used as the side clip 200 on the side portion 21C of the helmet body 21 to allow the angular position of the facemask 22 relative to the face of the wearer and/or the height of the facemask 22 relative to the helmet body 21 to be adjustable.

The adjustment mechanism 530 includes a base 531 configured to be engaged to the helmet body 21 (e.g. in a fixed position) and an engagement member 532. The engagement member 532 defines a seat portion 533 for receiving the facemask portion 23. The seat portion 533 is defined via a J-shaped hook 533A for receiving the facemask portion 23. As shown in FIGS. 1-2, the adjustment mechanism 530 receives the facemask portion 23 (wire) into the inverted J-shaped hook 533A, and the seat portion 533 defined by the J-shaped hook 533A acts as a stopper preventing upward movement of the facemask portion 23 received therein. It is understood that the seat portion 533 can have any other adequate configuration allowing it to act as a stopper to prevent movement of the facemask portion 23 received therein in at least one direction, e.g. upwardly.

The engagement member 532 includes a movable portion 534 slidable with respect to the base 531 in the vertical direction Y. The movable portion 534 extends downwardly in the vertical direction Y from the J-shaped hook 533A into a movable (e.g. slidable) engagement with respect to the base 531. In a particular embodiment, the adjustment mechanism 530 allows to select the angular position of the facemask 22 with respect to the face of the wearer and to move the bottom portion of the facemask 22 closer or further away from the face, for example to position the chin cup 24 received in the facemask 22. The angular position and/or height of the facemask 22 relative to the helmet body 21 can thus be changed through sliding of the engagement member 532 by the wearer using only his/her fingers or hands without the need to use tools and without having to remove the facemask 22 from the helmet body 21.

The relative position between the engagement member 532 and the base 531 can be locked by any suitable type of locking mechanism. In the embodiment shown, the locking mechanism includes a locking member 537 that can be manually positioned in an engaged position and a disengaged position. The locking member 537 includes locking teeth 536 (FIG. 14) on an outer surface thereof. The locking member 537 is disposed within an opening 537A (FIG. 15) of the base 531 thereby engaging the base 531 and blocking displacement of the locking member 537 in the vertical direction Y within the opening 537A. The locking member 537 is slidable with respect to the base 531 transversely to the movement between the engagement member 532 and the base 531 between the engaged and disengaged position.

The inner surface of the movable portion 534 has guide slots 538 defined therein (FIG. 15); the inner surface faces the outer surface of the locking member 537 for engaging the locking teeth 536. In the engaged position, the locking teeth 536 are received in the guide slots 538 and the locking member 537 simultaneously engages the base 531 and the movable portion 534 to lock the relative position between the base 531 and the engagement member 532, as shown in FIG. 13. In the disengaged position, the teeth 536 of the locking member 537 are positioned away from the guide slots 538 to allow the relative movement between the engagement member 532 and the base 531.

In use, the engagement member 532 is displaced along the base 531 in the vertical direction Y to adjust the position of the facemask 22 relative to the helmet body 21 by blocking or stopping movement of the facemask portion 23. Upon reaching the desired position, the locking member 537 is positioned in the opening 537A of the base 531 such that the locking teeth 536 are engaged with the corresponding guide slots 538 of the sliding member 534 to lock the position of the facemask 22 relative to the helmet body 21.

It is understood that alternately, the locking teeth can be replaced by any other adequate locking mechanism to engage the locking member 537 with the sliding member 534, including, but not limited to, a press-fit engagement and angled connections.

Figure 16A:
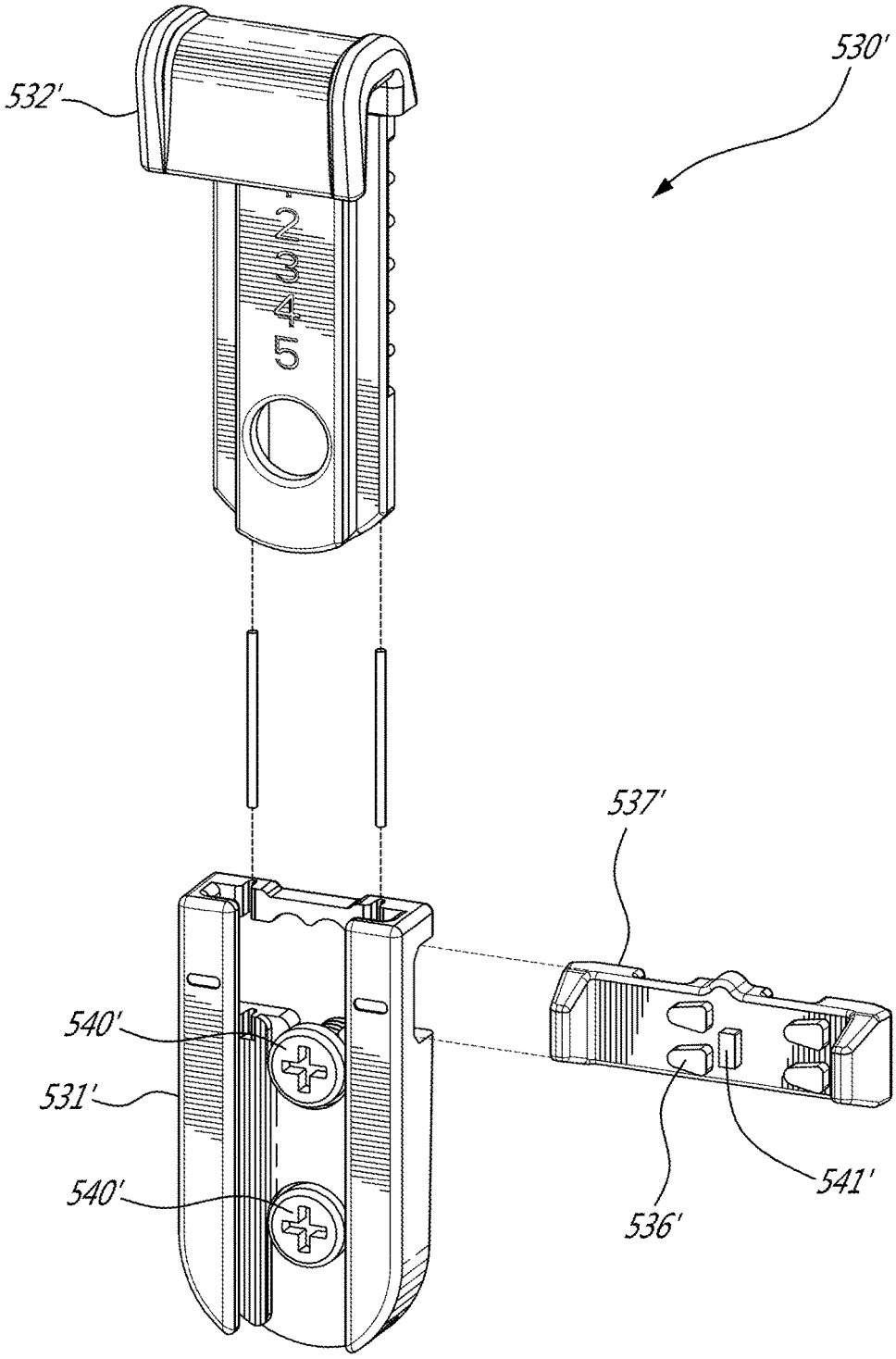
FIGS. 16A-16B are a schematic tridimensional exploded views of an adjustment mechanism, according to another embodiment of the present disclosure.
Figure 16B:
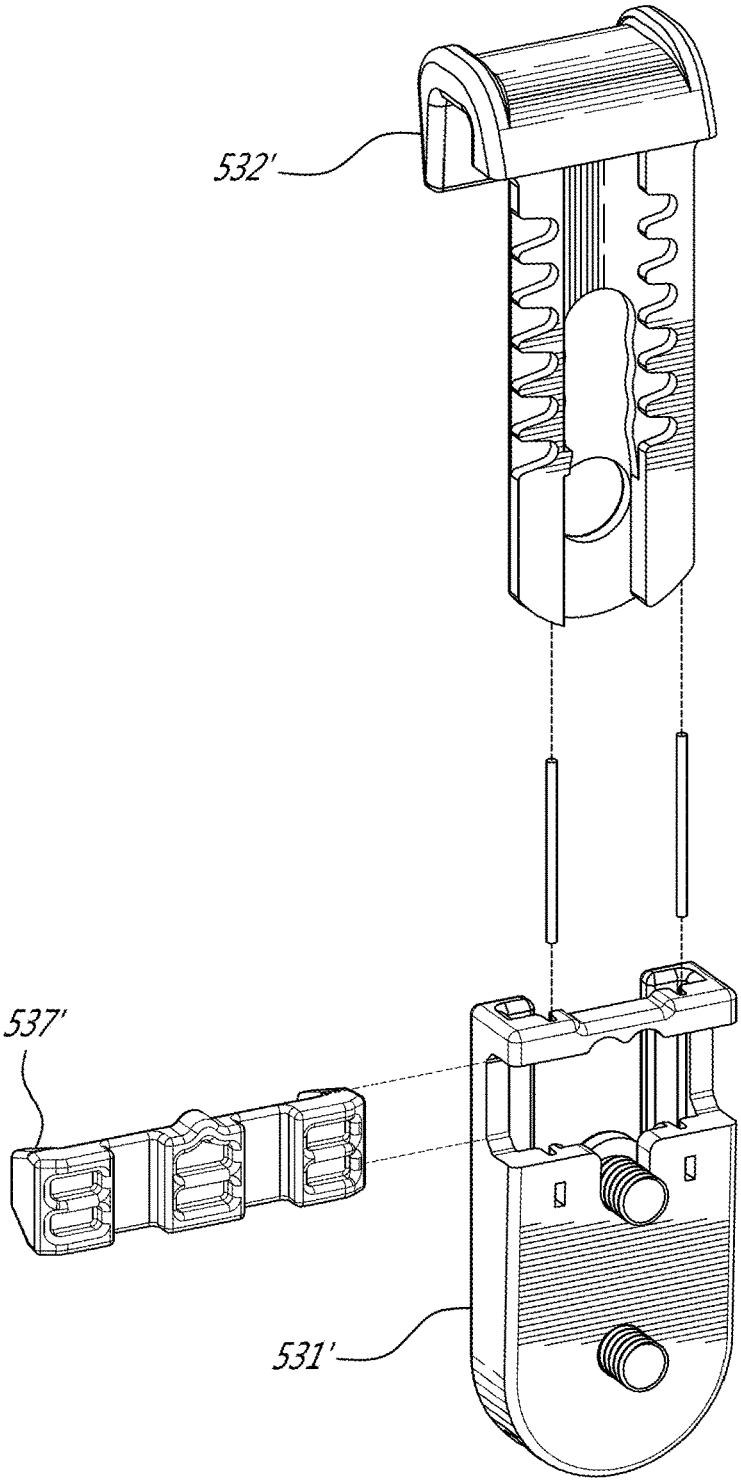
Figure 17:
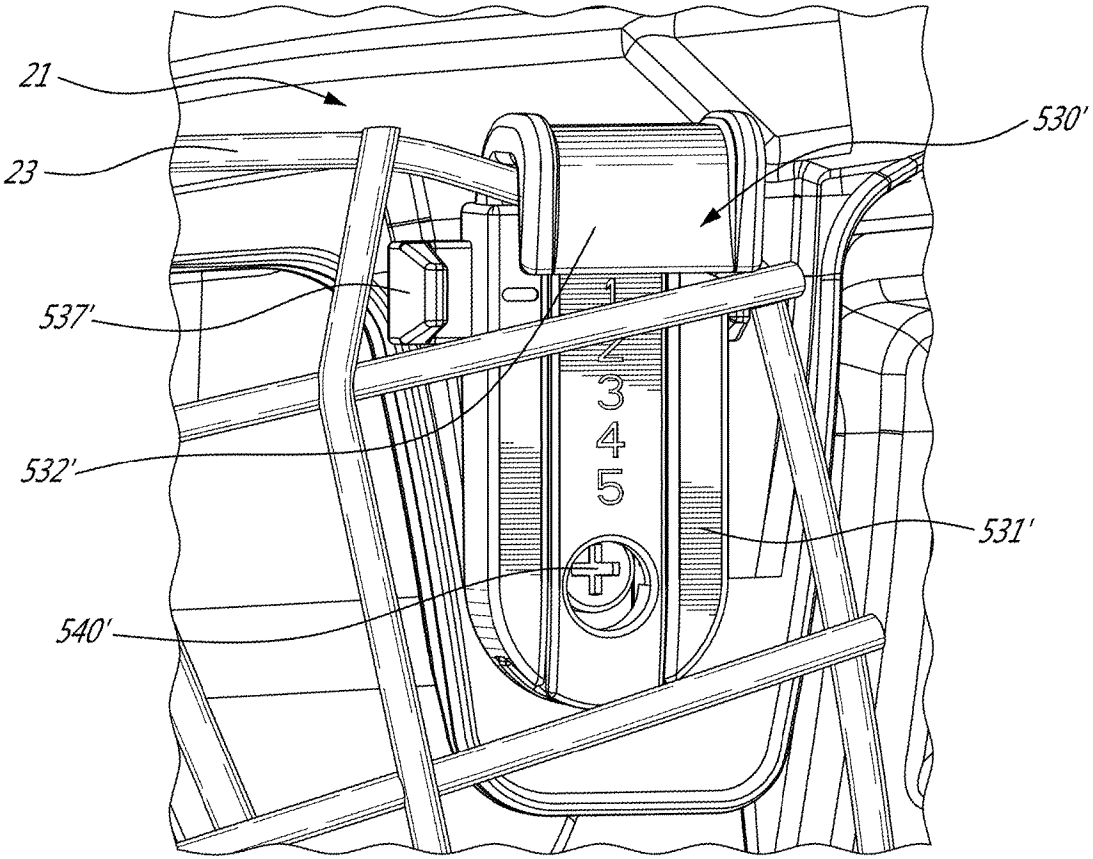
FIG. 17 is a schematic tridimensional view of the adjustment mechanism of FIGS. 16A-16B installed on the helmet of FIG. 1.

Referring to FIGS. 16A, 16B and 17, an adjustment mechanism 530' according to an alternate embodiment is shown, which is also particularly suitable to be used as the side clip 200 on the side portion 21C of the helmet body 21 to allow the angular position of the facemask 22 relative to the face of the wearer and/or the height of the facemask 22 relative to the helmet body 21 to be adjustable. The operation of the adjustment mechanism 530' for positioning the facemask 22 relative to the helmet body 21 is similar to the operation of the adjustment mechanism 530.

The adjustment mechanism 530' includes a base 531' configured to be engaged to the helmet body 21 (e.g. in a fixed position) and an engagement member 532'. In the embodiment shown, the base 531' includes two fasteners 540' to engage to the helmet body 21. Each fastener 540' can be received in a corresponding opening of the base 531' and extend therethrough to be further received in the helmet body 21.

The adjustment mechanism 530' also includes a locking member 537' that can be manually positioned in an engaged position and a disengaged position, similar to the locking member 537. The locking member 537' includes locking teeth 536' and a stopper 541' (FIG. 16A) on an outer surface thereof, between the two sets of locking teeth 536'. The locking member 537' is slidable with respect to the base 531' transversely to the movement between the engagement member 532' and the base 531' between the engaged and disengaged positions, which are similar to that of the locking member 537 described above. The stopper 541' is received within an elongated slot of the engagement member 532' to guide the displacement of the engagement member 532' between the engaged and disengaged position and maintain the engagement member 532' in engagement with the base 531' in both positions.

Figure 18:
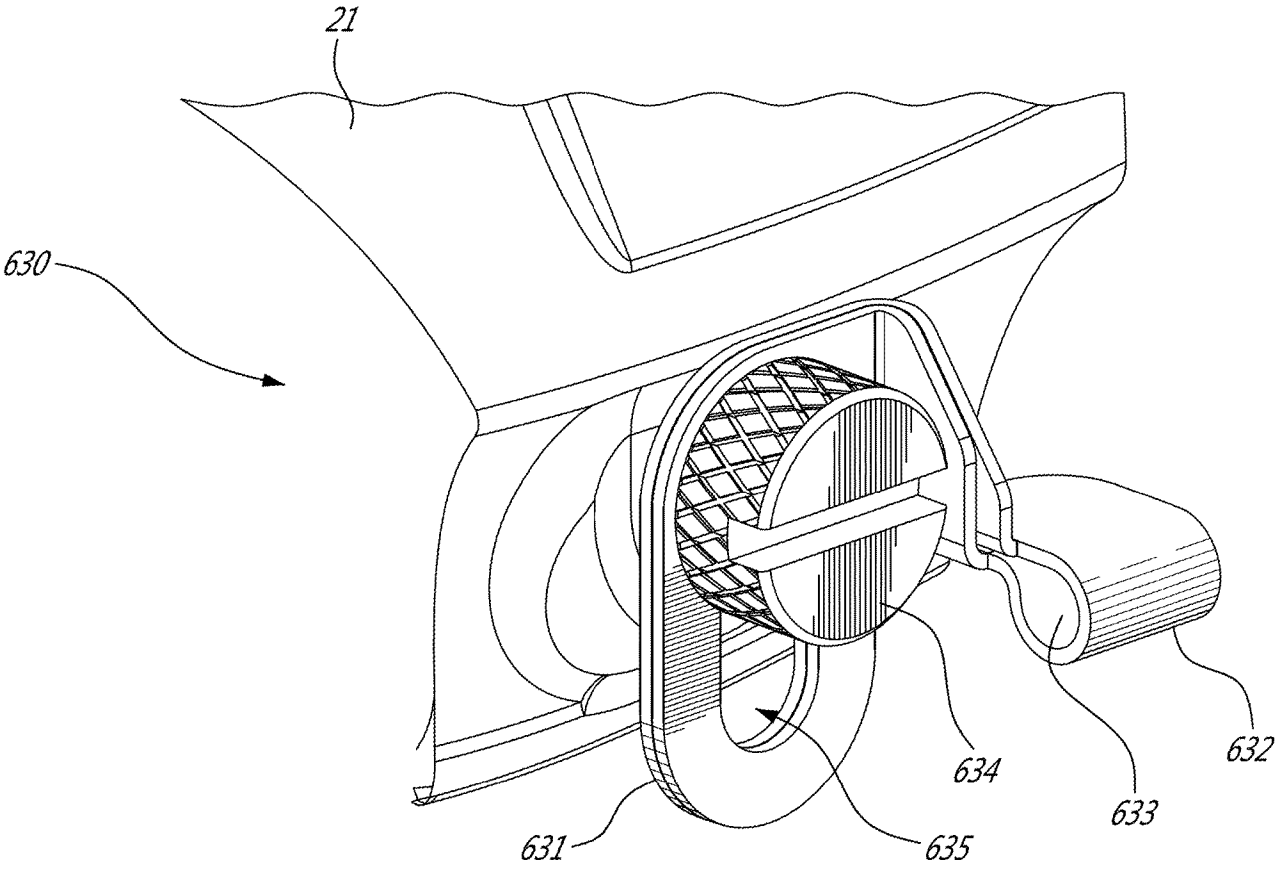
FIG. 18 is a schematic tridimensional view of an adjustment mechanism, according to another embodiment of the present disclosure.

Referring to FIG. 18, an adjustment mechanism 630 according to another embodiment is shown, which is particularly suitable to be used as the front clip 100 on the front portion 21A of the helmet body 21 to allow the height of the facemask 22 with respect to the face of the wearer to be adjustable. The adjustment mechanism 630 includes a base 631 and an engagement member 632 which has a fixed position with respect to the base 631. The engagement member 632 defines a seat portion 633 for receiving the facemask portion 23.

The adjustment mechanism 630 includes a manual fastener 634 to secure the base 631 on the helmet body 21 in a selected one of a plurality of vertically spaced apart positions, and thus varying a relative position of the facemask 22 relative to the helmet body 21 by the wearer using only his/her fingers or hands without the need to use tools and without having to remove the facemask 22 from the helmet body 21.

The base 631 defines an elongated slot 635 to receive the manual fastener 634, the relative position of the base 631 with respect to the helmet body 21 being determined through sliding of the fastener 634 within the slot 635. In the illustrated embodiment, the manual fastener 634 is a thumb screw, and is threadingly adjusted between an engaged position and a disengaged position. In the engaged position, the manual fastener 634 engages the helmet body 21 and frictionally engages an outer surface of the base 631 to lock the position of the base 631, and thus of the engagement member 632, relative to the helmet body 21. In the disengaged position, the manual fastener 634 is loosened to break the frictional engagement and allow the relative movement between the base 631 and the helmet body 21.

Figure 19:
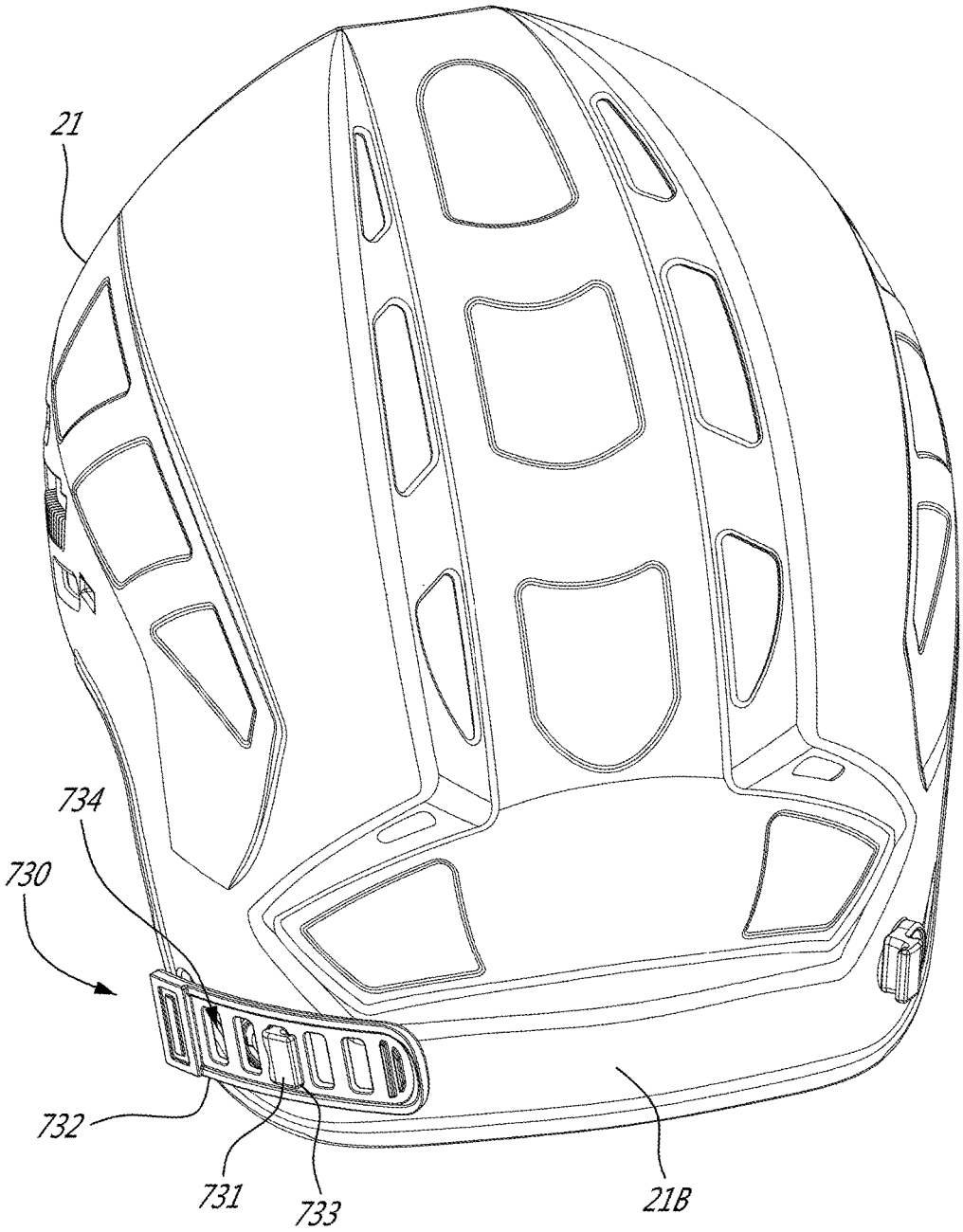
FIG. 19 is a schematic tridimensional view of the helmet shown in FIG. 1 having an adjustment mechanism according to another embodiment of the present disclosure.

Referring to FIG. 19, an additional adjustment mechanism 730 according to a particular embodiment is shown. The adjustment mechanism 730 can be used to adjust the position of a bottom portion of the facemask 22 which is for example retained along its top portion by any one or any combination of the adjustment mechanisms discussed above. The adjustment mechanism 730 includes a base 731, which in the embodiment shown is defined as an integral part of the rear portion 21B of the helmet body, and a hook 733 extending from the base 731. A strap 732, which may be made of flexible material, is connected to the portion of the facemask 22, for example the bottom portion or side portion of the facemask 22. The strap 732 has a plurality of spaced apart apertures 734 defined therethrough, each sized to snugly engage the hook 733 for securing a lower portion of the facemask 22 to the helmet body 21. The engagement of the hook 733 in the selected aperture 734 selects one of a plurality of spaced apart positions of the bottom portion of the facemask 22 relative to the helmet body, depending on an angular orientation defined from a pivoting motion about the adjustment mechanisms retaining the top portion and/or side portions of the facemask.

Alternately embodiment, the strap 732 can include a single aperture for select engagement with one of a plurality of hooks extending from the base 731; other types of adjustable attachment mechanisms can alternately be used, including, but not limited to, hook and loop type fasteners (Velcro™).

Figure 20:
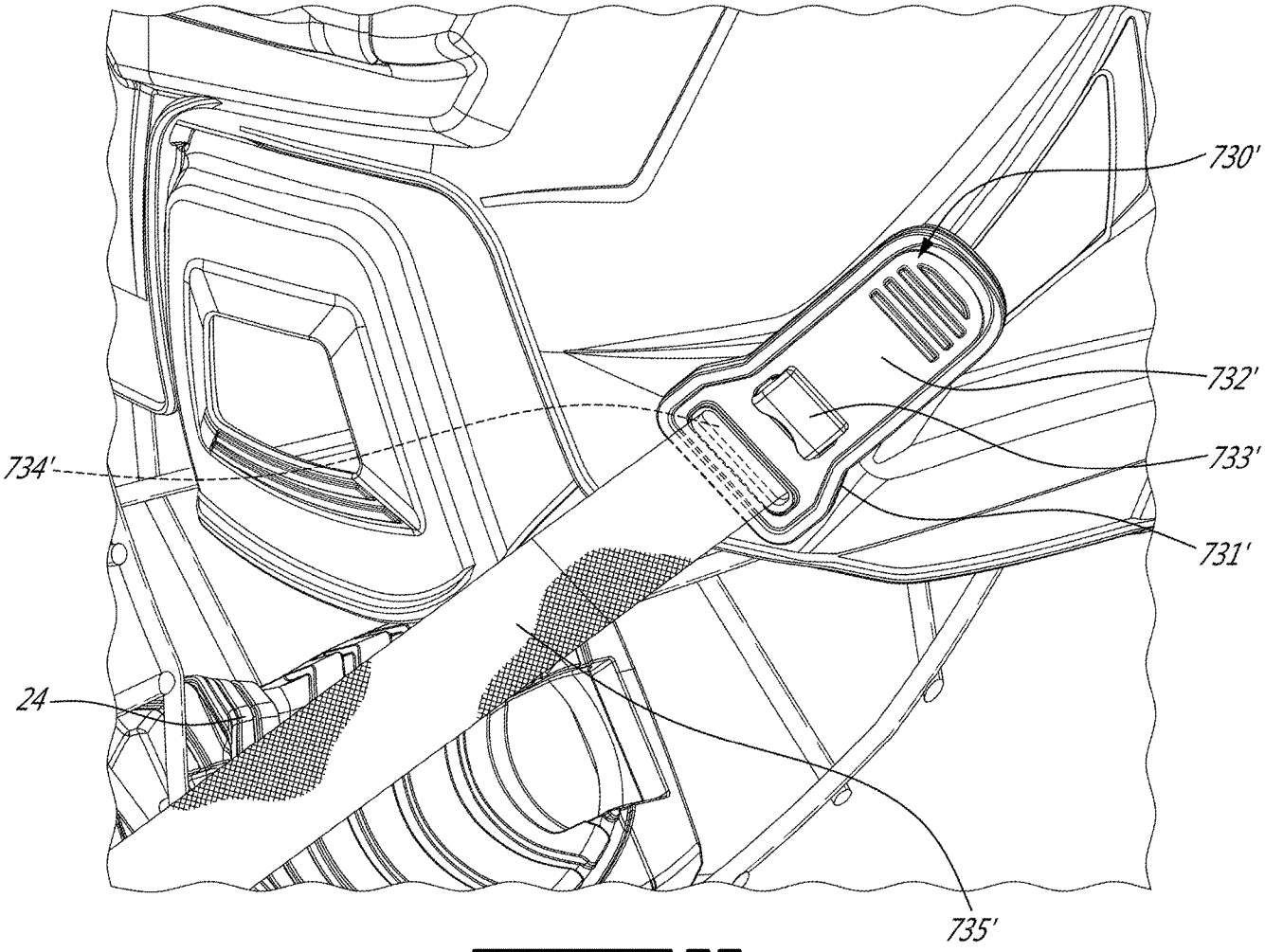
FIG. 20 is a schematic tridimensional view of part of the helmet shown in FIG. 1 having an adjustment mechanism according to another embodiment of the present disclosure.

Referring to FIG. 20, an additional adjustment mechanism 730' according to another particular embodiment is shown, which can also be used to adjust the position of the bottom portion of the facemask 22. The adjustment mechanism 730' also includes a base 731' defined as an integral part of the rear portion 21B of the helmet body, and a hook 733' extending from the base 731'. A strap engagement member 732' has an aperture 734' defined therethrough sized to snugly engage the hook 733'. The strap engagement member 732' is configured to engage a strap 735' in an adjustable manner; the strap 735' is engaged to a lower portion of the facemask 22, for example to the chin cup 24. The strap 735' is made of extensible material, for example natural or synthetic rubber.

It is understood that the adjustment mechanisms 30, 130, 230, 330, 430, 430', 430", 530, 530' and 630 can be used interchangeably, in any combination and in any suitable location on the helmet body 21.

The adjustment mechanisms allow for positioning the facemask engaged by adjusting the position of at least a portion of the adjustment mechanism in correspondence with a selected position of the facemask in a toolless manner, and/or by engaging a portion of the facemask in a selected one of vertically spaced apart seat portions of the adjustment mechanism in correspondence with the selected position of the facemask, also in a toolless manner.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A protective helmet comprising:

a helmet body having a front portion;

a facemask extending from the front portion to cover at least a portion of a face of a wearer;

at least one adjustment mechanism securing the facemask to the helmet body, the at least one adjustment mechanism including a base defining an aperture, the at least one adjustment mechanism connected to the helmet by a fastener received through the aperture and including an engagement member engaged with the facemask, the at least one adjustment mechanism being selectively engageable with the facemask in at least two vertically spaced apart positions of the facemask relative to the helmet body, the at least one adjustment mechanism allowing toolless adjustment between the at least two vertically spaced apart positions.

2. The protective helmet as defined in claim 1, wherein the base has at least one lug extending from a surface of the base and defining the aperture.

3. The protective helmet as defined in claim 1, wherein the engagement member has a fixed position relative to the helmet body and includes at least two vertically spaced apart seat portions each configured to removably engage a same portion of the facemask, each of the at least two vertically spaced apart positions corresponding to a respective one of the at least two vertically spaced apart seat portions.

4. The protective helmet as defined in claim 1, wherein the engagement member being connected to the base and vertically slidable with respect thereto between the at least two vertically spaced apart positions.

5. The protective helmet as defined in claim 4, wherein the at least two vertically spaced apart positions are defined by a plurality of discrete, releasably locked relative positions of the base and engagement member.

6. The protective helmet as defined in claim 4, further comprising a locking mechanism operable between an engaged position and a disengaged position, wherein in the engaged position a lock member of the locking mechanism prevents relative movement between the base and the engagement member, and in the disengaged position, the lock member releases the engagement member and the base to allow relative movement therebetween.

7. The protective helmet as defined in claim 6, wherein one of the lock member and engagement member includes locking teeth and the other of the lock member and engagement member has guide slots defined therein complementary to the locking teeth, the lock member slidable with respect to the engagement member between the engaged and disengaged positions in a direction transverse to that of the sliding movement between the engagement member and the base, the locking teeth being received in the guide slots and the lock member being engaged with the base in the engaged position.

8. The protective helmet as defined in claim 1, wherein the at least one adjustment mechanism is connected to the helmet body such as to be vertically slidable with respect thereto between the at least two vertically spaced apart positions.

9. The protective helmet as defined in claim 1, wherein the at least one adjustment mechanism engages the facemask along a top portion thereof, the facemask further including a strap extending from a bottom portion of the facemask and engageable to the helmet body in an adjustable manner to define a selected one of a plurality of spaced apart positions of the bottom portion of the facemask relative to the helmet body.

10. An adjustment mechanism for connecting a facemask to a helmet, the adjustment mechanism comprising:

a base configured to be connected to a helmet body of the helmet; and an engagement member connected to the base and defining at least two vertically spaced apart seat portions, each of the seat portions configured for engaging and disengaging a same portion of the facemask in a toolless manner to provide adjustment of a vertical position the facemask relative to the helmet body.

11. The adjustment mechanism as defined in claim 10, comprising a movable cover cooperating with the engagement member to close the at least two seat portions and enclose the portion of the facemask therein.

12. An adjustment mechanism for connecting a facemask to a helmet, the adjustment mechanism comprising:

a base defining an aperture and configured to be connected to a helmet body of the helmet by a fastener received through the aperture; and an engagement member connected to the base and defining a seat portion configured for engaging a portion of the facemask, the engagement member slidable with respect to the base to selectively position the seat portion between at least two vertically spaced apart positions relative to the helmet body, the engagement member slidable between the at least two vertically spaced apart positions in a toolless manner to provide adjustment of a vertical position the facemask relative to the helmet body.

13. The adjustment mechanism as defined in claim 12, further comprising a locking mechanism operable between an engaged position and a disengaged position, wherein in the engaged position a lock member of the locking mechanism prevents relative movement between the base and the engagement member, and in the disengaged position, the lock member releases the engagement member and the base to allow relative movement therebetween.

14. The adjustment mechanism as defined in claim 13, wherein one of the lock member and engagement member includes locking teeth and the other of the lock member and engagement member has guide slots defined therein complementary to the locking teeth, the lock member slidable with respect to the engagement member between the engaged and disengaged positions in a direction transverse to that of the sliding movement between the engagement member and the base, the locking teeth being received in the guide slots and the lock member being engaged with the base in the engaged position.

15. The adjustment mechanism as defined in claim 12, wherein the at least two vertically spaced apart positions are defined by a plurality of discrete, releasably locked relative positions of the base and engagement member.

16. The adjustment mechanism as defined in claim 12, wherein the at least one seat portion includes J-shaped hook for engaging the portion of the facemask.

* * * * *